US008385789B2

(12) United States Patent
Sato et al.

(10) Patent No.: US 8,385,789 B2
(45) Date of Patent: Feb. 26, 2013

(54) DEVELOPMENT DEVICE AND IMAGE FORMING DEVICE

(75) Inventors: Shougo Sato, Aichi (JP); Kenjiro Nishiwaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 287 days.

(21) Appl. No.: 12/732,261

(22) Filed: Mar. 26, 2010

(65) Prior Publication Data

US 2010/0316418 A1 Dec. 16, 2010

(30) Foreign Application Priority Data

Jun. 12, 2009 (JP) ..... 2009-141452
Jun. 12, 2009 (JP) ..... 2009-141453
Jun. 12, 2009 (JP) ..... 2009-141454

(51) Int. Cl.
*G03G 15/08* (2006.01)

(52) U.S. Cl. ..... 399/266

(58) Field of Classification Search ..... 399/266, 399/281

See application file for complete search history.

(56) References Cited

U.S. PATENT DOCUMENTS

| | | | | |
|---|---|---|---|---|
| 5,510,883 | A | 4/1996 | Kimura et al. | |
| 5,537,191 | A | 7/1996 | Aruga et al. | |
| 7,062,204 | B2 * | 6/2006 | Miyaguchi et al. | 399/252 |
| 7,187,892 | B2 | 3/2007 | Hiroke et al. | |
| 7,734,233 | B2 * | 6/2010 | Aoki et al. | 399/266 |
| 7,738,821 | B2 | 6/2010 | Nishiwaki | |
| 2005/0025525 | A1 | 2/2005 | Horike et al. | |
| 2007/0122203 | A1 | 5/2007 | Sugimoto et al. | |
| 2009/0080942 | A1 | 3/2009 | Nishiwaki et al. | |
| 2009/0175662 | A1 | 7/2009 | Nishiwaki | |
| 2010/0247158 | A1 | 9/2010 | Nishiwaki | |

FOREIGN PATENT DOCUMENTS

| | | | |
|---|---|---|---|
| JP | 63246780 | A | 10/1988 |
| JP | 4186265 | A | 7/1992 |
| JP | 6035317 | A | 2/1994 |
| JP | 7114315 | A | 5/1995 |
| JP | 11-084862 | | 3/1999 |
| JP | 2001312128 | A | 11/2001 |

(Continued)

OTHER PUBLICATIONS

Notification of Reasons for Rejection for Japanese patent application No. 2009-141453 mailed Aug. 16, 2011.

(Continued)

*Primary Examiner* — David Gray
*Assistant Examiner* — Gregory H Curran
(74) *Attorney, Agent, or Firm* — Banner & Witcoff, Ltd.

(57) ABSTRACT

A development device, comprising: a casing; a developer reservoir formed at a bottom part of the casing; a developer supply chamber that accommodates the developer; a developer holding body that is provided to be rotatable about a rotation axis extending in a width direction of the casing and is located on an upper side of the developer reservoir to face an image holding body; a first carry member that is provided in the developer supply chamber to extend in the width direction and to carry the developer to the width direction, a second carry member that is provided on a casing side to extend in the width direction and to carry the developer to the width direction; and a carry substrate that is provided in the casing so that the developer is carried from the developer reservoir to a position facing the developer holding body.

19 Claims, 17 Drawing Sheets

FOREIGN PATENT DOCUMENTS

| | | | |
|---|---|---|---|
| JP | 2002-287495 | | 10/2002 |
| JP | 2003-084569 | | 3/2003 |
| JP | 2003-084570 | | 3/2003 |
| JP | 2004-279880 | | 10/2004 |
| JP | 2005062809 | A | 3/2005 |
| JP | 2007-148014 | | 6/2007 |
| JP | 2008070803 | A | 3/2008 |
| JP | 2008145758 | A | 6/2008 |
| JP | 2008299105 | A | 12/2008 |
| JP | 2009080271 | A | 4/2009 |
| JP | 2009080299 | A | 4/2009 |

OTHER PUBLICATIONS

Office action for Japanese patent application No. 2009-141453 mailed Dec. 6, 2011.

Notification of Reasons for Rejection for Japanese patent application No. 2009-141453 mailed May 10, 2011.

* cited by examiner

1C

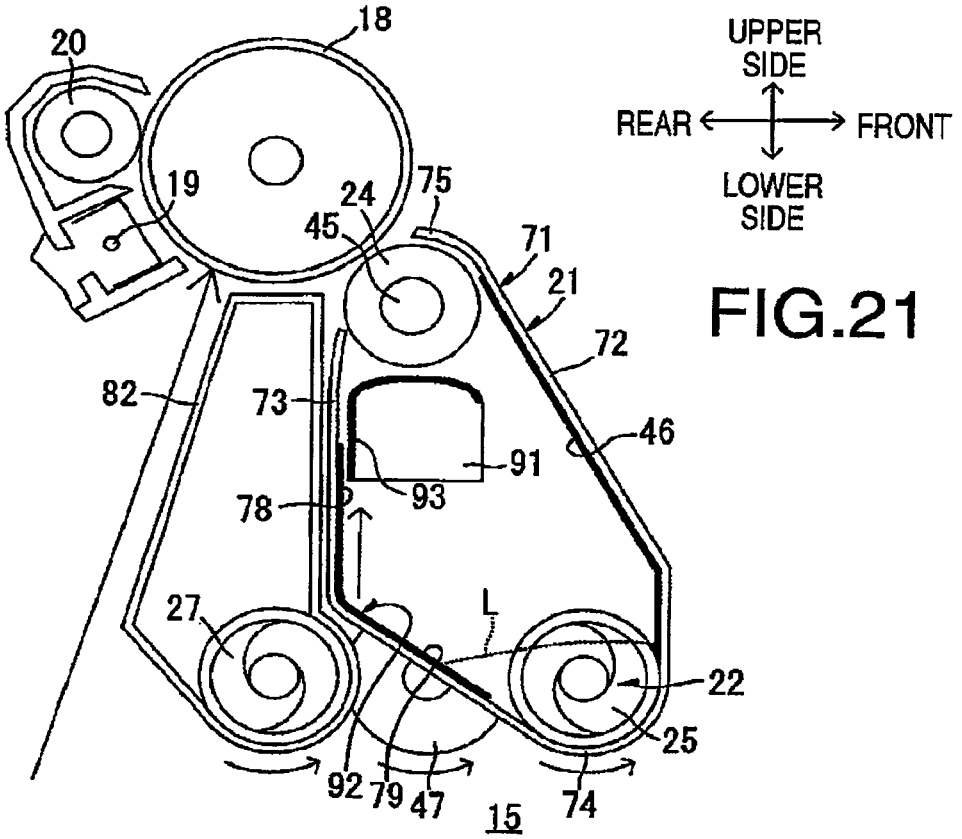
FIG.21
FIG.22
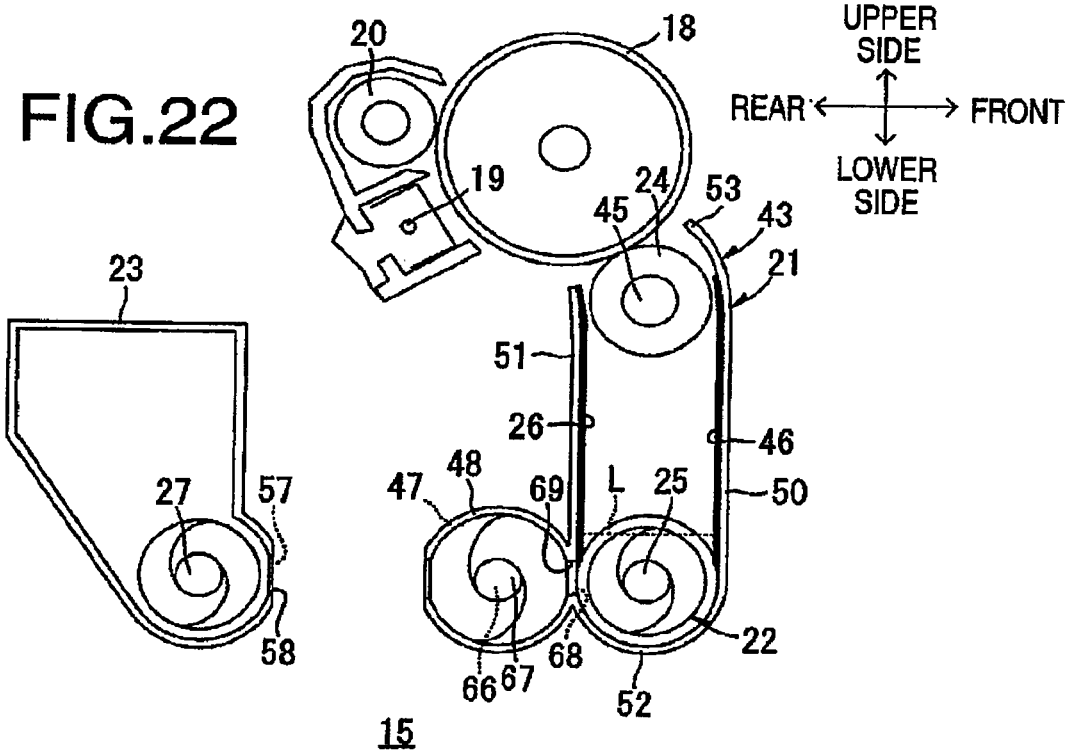

DEVELOPMENT DEVICE AND IMAGE FORMING DEVICE

CROSS-REFERENCE TO RELATED APPLICATION

This application claims priority under 35 U.S.C. §119 from Japanese Patent Applications No. 2009-141452, filed on Jun. 12, 2009, No. 2009-141453, filed on Jun. 12, 2009, and No. 2009-141454, filed on Jun. 12, 2009. The entire subject matter of the applications is incorporated herein by reference.

BACKGROUND

1. Technical Field

Aspects of the present invention relate to a development device for developing a toner image and to an image forming device in which the development device is provided.

2. Related Art

In general, image forming devices, such as a copying device, a printer and a facsimile device are provided with a development device for developing an electrostatic latent image formed on a photosensitive drum. As an example of a development device, a development device configured to electrostatically carry toner is widely used. More specifically, the development device includes a toner box for accommodating charged toner and two carrying substrates for carrying the charged toner from the toner box to the photosensitive drum.

In the development device, the toner in the toner box is carried to the photosensitive drum through an electrostatic force generated by each carrying substrate. Then, the toner jumps from a downstream end of the carrying substrate to the photosensitive drum through an electrostatic force.

SUMMARY

However, there is a case where toner not properly charged (e.g., toner not charged or the toner charged to have an inversed polarity) is mixed into the toner in the toner box. In this case, the quality of a formed image may be deteriorated.

In order to solve such a problem, a designer of the development device might consider to shake off the toner not properly charged through gravity along a carrying path of the developer. However, it becomes necessary to secure a constant carrying distance of the toner to stably shake off the toner through gravity.

Aspects of the present invention are advantageous in that they provide at least one of a development device and an image forming device configured to stably shake off a developer along a carrying path of the developer is provided.

According to an aspect of the invention, there is provided a development device for supplying a developer to an image holding body, comprising: a casing; a developer reservoir formed at a bottom part of the casing to store the developer; a developer supply chamber that accommodates the developer; a developer holding body that is a roller-like member provided to be rotatable about a rotation axis extending in a width direction of the casing and is located on an upper side of the developer reservoir in the casing such that an outer circumferential surface of the developer holding body faces the image holding body; a first carry member that is provided in the developer supply chamber to extend in the width direction of the casing and to carry the developer to the width direction, the first carry member supplying the developer to the developer reservoir; a second carry member that is provided on a casing side to extend in the width direction of the casing and to carry the developer to the width direction; and a carry substrate that is provided in the casing, the carry substrate being provided with a plurality of carrying electrodes which generate an electric field by application of a voltage such that the developer is carried from the developer reservoir to a position facing the developer holding body.

BRIEF DESCRIPTION OF THE ACCOMPANYING DRAWINGS

FIG. 21 is a side cross section of a process unit according to a second variation of the third embodiment.

FIG. 22 is a side cross section of a process unit according to a third variation of the third embodiment.

DETAILED DESCRIPTION

Hereafter, embodiments according to the invention will be described with reference to the accompanying drawings.

First Embodiment

Figure 1:
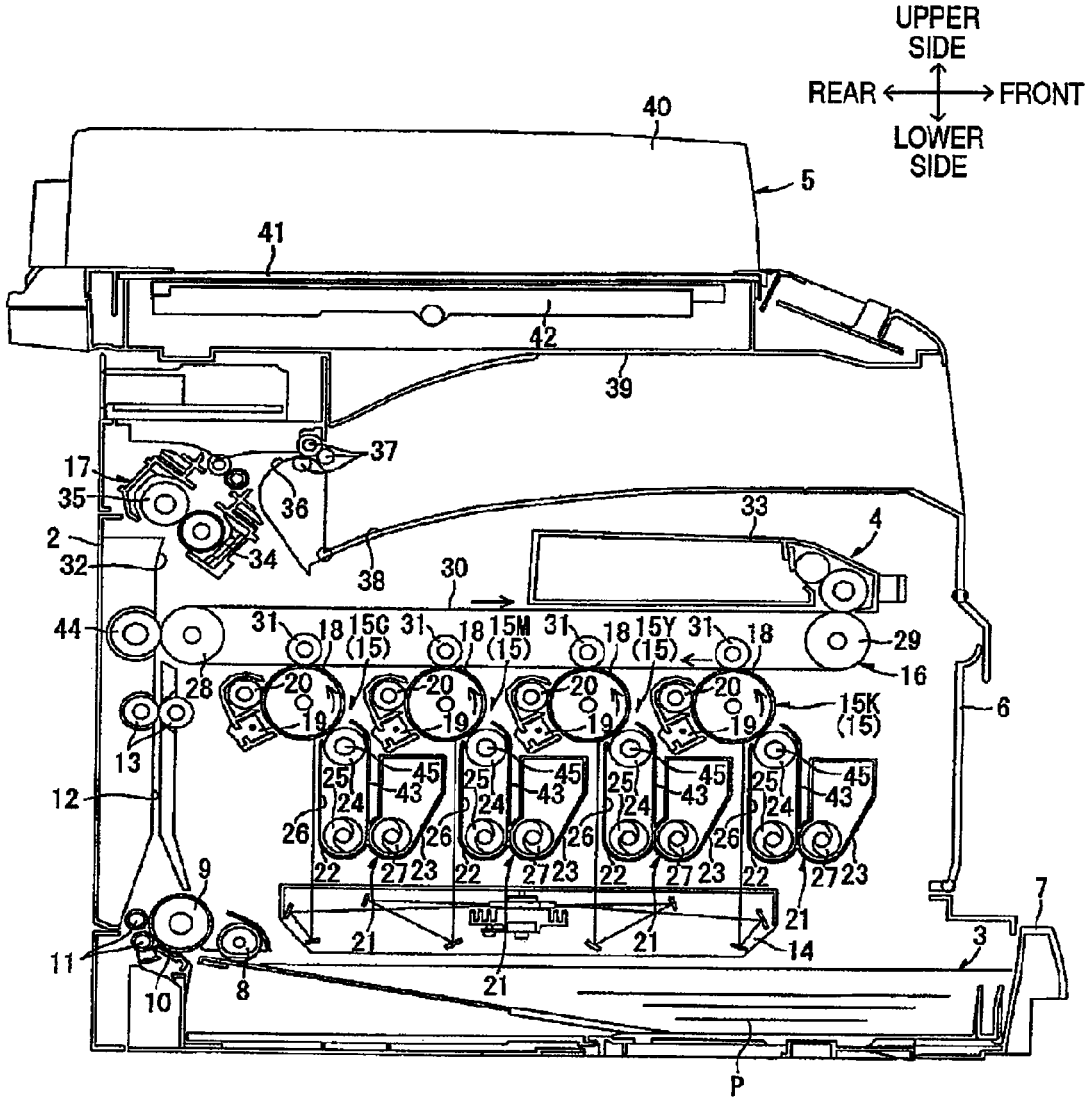
FIG. 1 is a side cross section of a laser printer according to a first embodiment.

As shown in FIG. 1, a laser printer 1 according to a first embodiment is a horizontal tandem-type color laser printer. The laser printer 1 has a body casing 2 in which a paper supply unit 3 which supplies a sheet of paper P (which is an example of a recording medium, an image formation unit 4 for forming an image on a sheet of paper P, and an image reading unit 5 for reading an image from a document are accommodated. That is, the laser printer 1 is a multifunction peripheral in which the image formation unit 4 and the image reading unit 5 are integrally provided.

The body casing 2 which accommodates the paper supply unit 3, the image formation unit 4 and the image reading unit 5 has a box-shape when viewed as a side view, and is provided with a front cover 6 on one side thereof.

In the following, the side on which the front cover 6 is provided is defined as a front side, and the opposite side (i.e., the left side on the paper of FIG. 1) is defined as a rear side. The left and right direction is defined in a state where the laser printer 1 is viewed from the front side. The up and down direction corresponds to the vertical direction, and the front and rear direction and the left and right direction are defined in the horizontal direction. The left and right direction is equivalent to the width direction of the laser printer 1.

The paper supply unit 3 is provided under the body casing 2. The paper supply unit 3 includes a paper supply tray 7 which accommodates the sheets of paper P, a supply roller 8 provided above the rear end of the paper supply tray 7, and a separation roller 9 and a separation pad 10 which are located to face with each other at the rear portion of the supply roller 8. Furthermore, the paper supply unit 3 includes a pair of auxiliary rollers 11 which are located to face with each other on the upper side of the separation pad 10, a paper supply path 12 extending upward from the portion where the separation roller 9 and the uppermost one of the auxiliary rollers 11 face with each other, and a pair of carrying rollers 13 located at midway positions on the paper supply path 12.

In the paper supply tray 7, a stack of sheets of paper P is accommodated. The uppermost one of the sheets of paper P is supplied by rotation of the supply roller 8, to the position where the separation roller 9 and the separation pad 10 face with each other. Thus, the sheets of paper P is sent out one-by-one from the paper supply tray 7. Then, the sheet of paper P is supplied from the separation roller 9 to the paper supply path 12 while being guided by each of the auxiliary rollers 11. The sheet of paper P is then carried by the carrying rollers 13, and is carried to a position between a second transfer roller 44 and an intermediate transfer belt 30 which are explained later.

The image formation unit 4 includes a scanning unit 14, four process units 15, a transfer unit 16 and a fixing unit 17.

The scanning unit 14 is located above the paper supply unit 3 in the lower portion in the body casing 2. As indicated by a solid line in FIG. 1, the scanning unit 14 emits a laser beam, which is based on image data, to four photosensitive drums 18.

The process units 15 are provided respectively for four colors. More specifically, the process units 15 include a black process unit 15K, an yellow process unit 15Y, a magenta process unit 15M and a cyan process unit 15C, which are arranged in this order from the front side while securing certain intervals therebetween.

Each of the process units 15 includes a photosensitive drum 18 (i.e., an image holding body), a scorotron charger 19, a cleaning roller 20 and a toner supply unit 21 (i.e., a development device).

Each photosensitive drum 18 is provided to extend in the left and right direction. The four photosensitive drums 18 are arranged in the front and rear direction at certain intervals. Each photosensitive drum 18 is rotated in the counterclockwise direction when viewed from the left side (see FIG. 1).

The scorotron charger 19 is provided under the rear part of the photosensitive drum 18 to face the photosensitive drum 18 at a certain interval. The cleaning roller 20 is provided on the rear side of the photosensitive drum 18 to face the photosensitive drum 18.

The four toner supply units 21 are provided respectively for the four photosensitive drums 18. Each toner supply unit 18 includes a casing 43, a toner reservoir 22 (i.e., a developer reservoir), and a toner supply chamber 23 (i.e., a developer supply chamber).

The casing 43 is provided under the front end of the photosensitive drum 18. The casing 43 has a box-shape extending in the up and down direction, and each of the ends defined in the up and down direction is formed to be a semispherical shape. The rear half part of the upper portion of the casing 43 is provided with an opening extending in the left and right direction such that the opening faces the photosensitive drum 18.

In the casing 43, a development roller 24 (i.e., a developer holding body), a sending carrying substrate 26 and a returning carrying substrate 27 are accommodated.

The development roller 24 is a roller-like member having a cylindrical circumferential surface, and is provided to be rotatable about a rotation axis 45 extending in the left and right direction. The development roller 24 is provided above the toner reservoir 22 at the upper end portion of the casing 43 so that the upper part the development roller 24 is exposed to the outside through the opening of the casing 43. The development roller 24 faces the photosensitive drum 18 from the obliquely defined lower side through the opening of the casing 43.

The sending carrying substrate 26 is provided integrally with an inner wall of a rear wall 51 of the casing 43, and the upper end of the sending carrying substrate 26 faces the rear end of the development roller 24 via a certain interval formed in the front and rear direction. The lower end of the sending carrying substrate 26 is provided to extend in the up and down direction so that the lower end of the sending carrying substrate 26 faces a rear end of a second screw 25 via a certain interval. As described later, the sending carrying substrate 26 carries toner upward in the up and down direction with an electrostatic force.

The returning carrying substrate 46 is provided integrally with an inner wall of a front wall 51 of the casing 43 to extend in the up and down direction. As described in detail later, the returning carrying substrate 46 carries the toner held on the development roller 24 downward in the up and down direction with an electrostatic force to circulate the toner to the toner reservoir 22.

The toner reservoir 22 is provided at the bottom part of the casing 43 to store a predetermined amount of toner. Further, the toner reservoir 22 includes the second screw 25 (serving as a second carry member). The screw 25 is provided along the left and right direction in the toner reservoir 22. As described later, the second screw 25 carries the toner from the right side to the left side. The toner supply chamber 23 is formed to be a box-shaped member extending in the left and right direction, and is connected to the toner reservoir 22 on the front side of the toner reservoir 22.

As described later, at a joint part of the toner reservoir 22 and the toner supply chamber 23, a reservoir side recovery opening 58 and a supply chamber side recovery opening 60 are formed at the left end portion, and a reservoir side supply opening 57 and a supply chamber side supply opening 59 are formed at the right end portion. In this configuration, the toner reservoir 22 and the toner supply chamber 23 communicate with each other via the reservoir side recovery opening 58, the supply chamber side recovery opening 60, the reservoir side supply opening 57 and the supply chamber side supply opening 59.

In the toner supply chamber 23, a first screw 27 (a first carry member) is provided. The first screw 27 is provided at the lower end portion of the toner supply chamber 23 to extend in the left and right direction. As described later, the first screw 27 carries the toner from the left side to the right side.

The toner stored in the toner supply chamber 23 is carried from the left side to the right side in the toner supply chamber 23 by rotation of the first screw 27, and is supplied to the toner reservoir 22 through the supply chamber side supply opening 59 and the reservoir side supply opening 57.

The toner supplied to the toner reservoir 22 is carried from the right side to the left side by rotation of the second screw 25. The toner being carried from the right side to the left side in the toner reservoir 22 contacts the sending carrying substrate 26 at midway positions.

The toner which has contacted the sending carrying substrate 26 is applied, from the sending carrying substrate 26, an electrostatic force pointing from the lower side to the upper side, and is carried from the lower side to the upper side. Then, the toner reaches the upper end of the sending carrying substrate 26 where the sending carrying substrate 26 faces the development roller 24.

The toner which has reached the position facing the development roller 24 jumps from the sending carrying substrate 26 to the development roller 24 while receiving the electrostatic force pointing from the sending carrying substrate 26 to the development roller 24, and is held on the outer circumferential surface of the development roller 24.

The outer circumferential surface of the photosensitive drum 18 is charged uniformly and positively by the scorotoron charger 19. Then, the positively charged outer circumferential surface of the development roller 18 is scanned by the laser beam from the scanning unit 14 while the development roller 18 rotates. As a result, an electrostatic latent image (i.e., an image to be formed on the sheet of paper P) is formed on the outer circumferential surface of the photosensitive drum 18.

While the photosensitive drum 18 is rotated, the toner held on the development roller 24 reaches a position facing the electrostatic latent image on the photosensitive drum 18. At this time, the toner held on the development roller 24 receives an electrostatic force pointing from the development roller 24 to the electrostatic latent image, and jumps toward the electrostatic latent image. Thus, the toner is supplied to the electrostatic latent image formed on the outer circumferential surface of the photosensitive drum 18.

The toner facing parts of the outer circumferential surface of the photosensitive drum 18 where the electrostatic latent image is not formed receives an electrostatic force pointing from the photosensitive drum 18 to the development roller 24, and therefore is not supplied to the photosensitive drum 18 and remains on the outer surface of the development roller 24. The toner remaining on the outer surface of the development roller 24 is carried by the returning carrying substrate 46 to the toner reservoir 22. Thus, the electrostatic latent image is developed, and a toner image is held on the outer circumferential surface of the photosensitive drum 18.

The transfer unit 16 is provided above the process units 15 to extend in the front and rear direction. The transfer unit 16 includes a drive roller 28, a driven roller 29, the intermediate transfer belt 30, a first transfer roller 31, the second transfer roller 44, a relay path 32, and a cleaning unit 33.

The drive roller 28 is located at a rear and upward portion defined in a slanting direction with respect to the photosensitive drum 18 of the cyan process unit 15C. The drive roller 28 is rotated in a direction (a clockwise direction in FIG. 1) opposite to the rotational direction of the photosensitive drum 18.

The driven roller 29 is located at a front and upward portion defined in a slanting direction with respect to the photosensitive drum 18 of the black process unit 15K, and is located to overlap with the drive roller 28 when viewed in the front and rear direction. When the drive roller 28 rotates, the drive droller 29 rotates in accordance with rotation of the drive roller 28 in the same rotational direction (the clockwise direction in FIG. 1) as that of the drive roller 28.

The intermediate transfer belt 30 is formed of an endless belt, and is hooked to be wound around the drive roller 28 and the driven roller 29. The intermediate transfer belt 30 is arranged to face the photosensitive drums 18 such that the surface of the intermediate transfer roller 30 contacts all the photosensitive drums 18 from the upper side.

By rotation of the drive roller 28, the driven roller 29 is rotated, and the intermediate transfer belt 30 moves to circulate in the clockwise direction in FIG. 1 between the drive roller 28 and the driven roller 29.

The first transfer roller 31 is located in the inside of the intermediate transfer belt 30 between the drive roller 28 and the driven roller 29. Four first transfer rollers 31 are provided to face the respective photosensitive drums 18 while sandwiching the intermediate transfer belt 30 therebetween. The second transfer roller 44 is located, on the rear side of the drive roller 28, to face the drive roller 28 while sandwiching the intermediate transfer belt 30 therebetween.

The relay path 32 is formed to extend upward in the substantially vertical direction, from the position where the second transfer roller 44 faces the intermediate transfer belt 30, to the fixing unit 17.

The intermediate transfer belt 30 sequentially passes, from the rear side to the front side, the positions where the intermediate transfer belt 30 contact the photosensitive drums 18. The toner image held on each photosensitive drum 18 is transferred primarily to the intermediate transfer belt 30 while the intermediate transfer belt 30 passes by each photosensitive drum 18. As a result, a color image is formed on the intermediate transfer belt 30.

The color image formed on the intermediate transfer belt 30 is secondarily transferred to the sheet of paper P being carried from the paper supply unit 3 while the intermediate transfer belt 30 passes the position where the intermediate transfer belt 30 faces the second transfer roller 44. The color image which has been transferred to the sheet of paper P is carried to the fixing unit 17 along the relay path 32.

The cleaning unit 33 located above the intermediate transfer belt 30 removes the toner adhered to the surface of the intermediate transfer belt 30 and stores the toner. The fixing unit 19 is located above the second transfer roller 44, and includes a heating roller 34 and a pressure roller 35 located to face the heating roller 34. The color image transferred to the sheet of paper is fixed on the sheet of paper P by being heated and pressed when passing between the heating roller 34 and the pressure roller 35.

The sheet of paper P on which the toner image is fixed passes along an ejection path 36, and is ejected on an output tray 38 formed above the body casing 2.

The image reading unit 5 is provided above the output tray 38, and includes a document base 39 and a pressure cover 40 which is supported on the document base 39 to be able to swing.

The document base 39 is a plate-like member having a rectangular shape when viewed as a plan view. On the document base 39, a glass plate 41 is provided. Under the glass plate 41, the document base 39 has a CCD sensor 42 for reading a document placed on the glass plate 41. The CCD sensor 42 is provided to be able to slide in the left and right direction while facing the glass plate 41 when a document is read.

The pressure cover 40 is formed to have a rectangular shape when viewed as a plan view so that the pressure cover 40 covers the document base 39. The pressure cover 40 swings between a closed position where the pressure cover 40 covers the glass plate 41 and an opened position where the pressure cover 40 stands to expose the upper surface of the glass plate 41 to the outside. In the image reading unit 5, after a document is set between the pressure cover 40 and the glass plate 42, the CCD sensor 42 is controlled to slide along the glass plate 42 to read the document.

Based on image information read from the document, an image is formed on the sheet of paper P by the image formation unit 4. The laser printer 1 may be connected to a personal computer (not shown). That is, the laser printer 1 has the function of transmitting the image information to the personal computer connected thereto or transmitting the image information to the personal computer via a public network.

Figure 2:
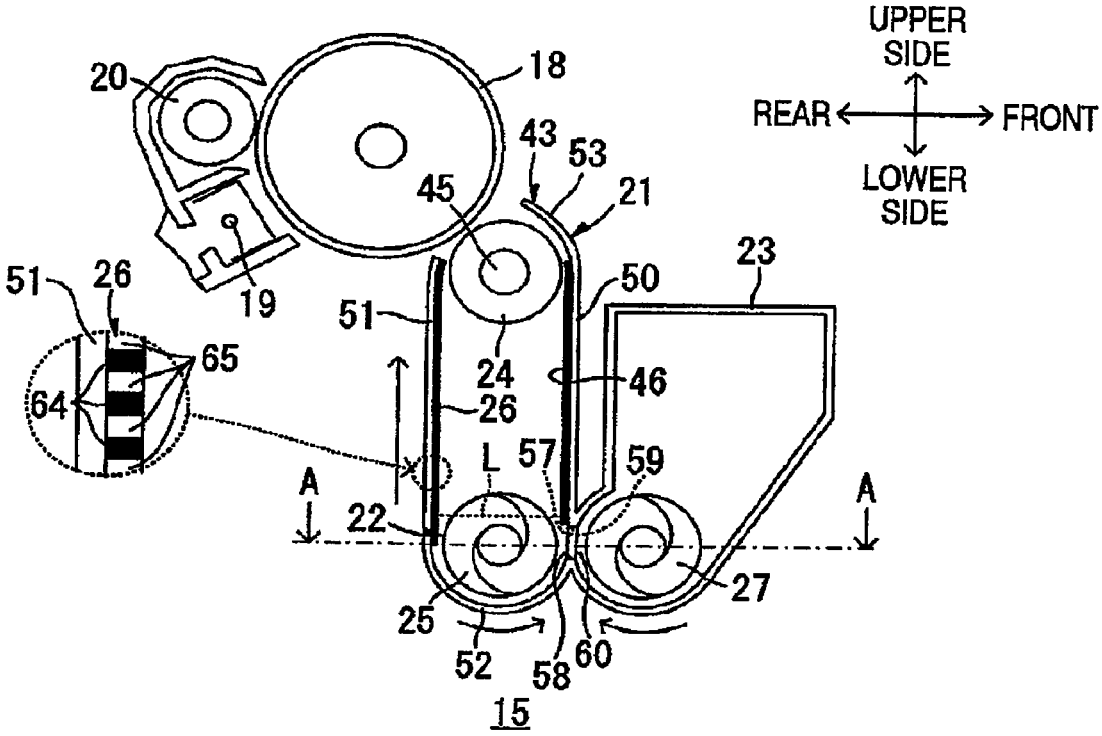
FIG. 2 is a side cross section of a process unit shown in FIG. 1.
Figure 3:
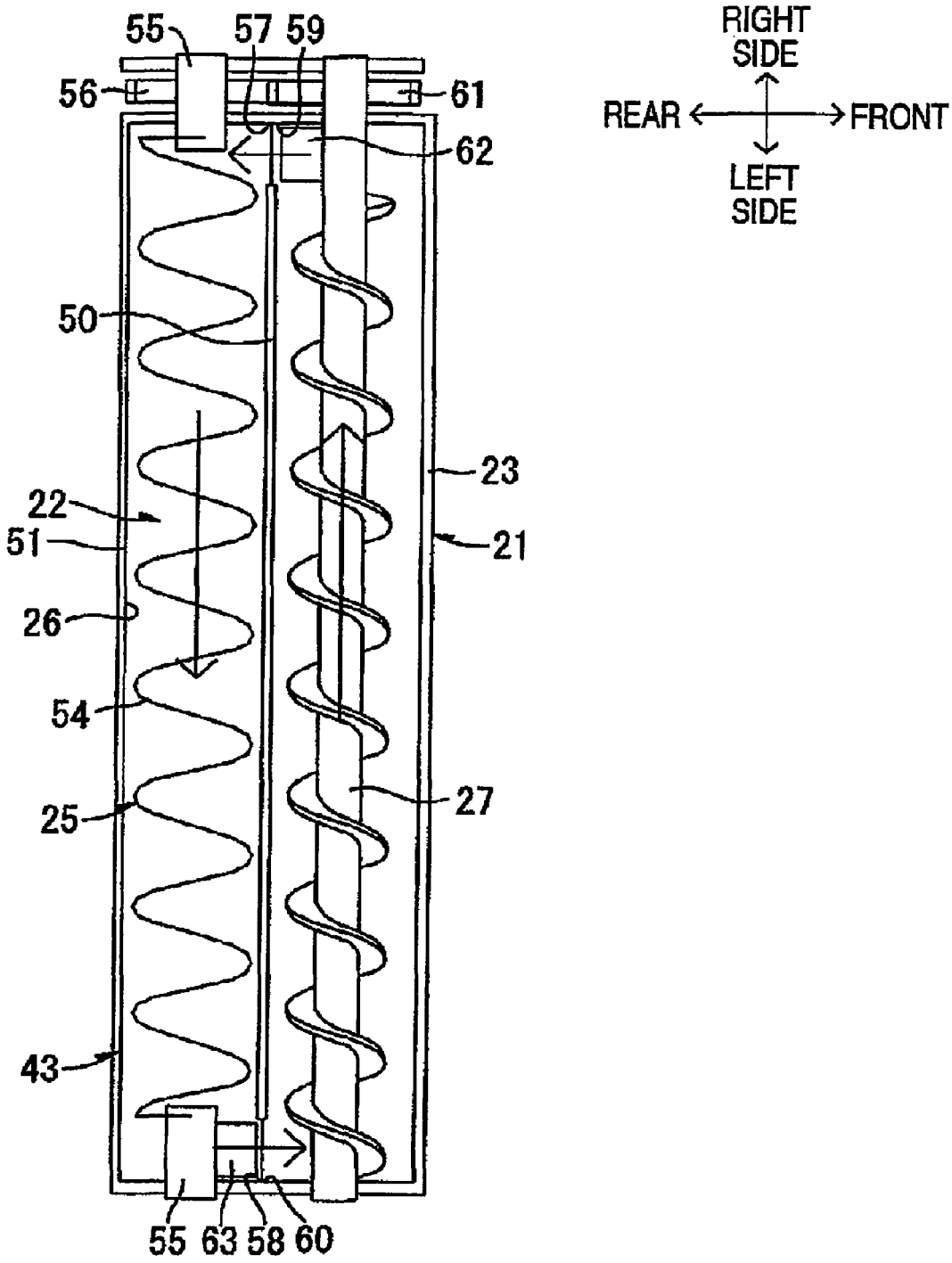
FIG. 3 is a cross sectional view of the process unit along a line A-A in FIG. 2.

As shown in FIGS. 2 and 3, the toner supply unit 21 includes the casing 43, the toner reservoir 22 and the toner supply chamber 23. The casing 43 has a front wall 50, a rear wall 51, a bottom wall 52 and a top wall 53. The ends of the casing 43 in the left and right direction are closed by a pair of side walls. Each of the front wall 50 and the rear wall 51 is elongated in the up and down direction, and is formed to be a plate-like member when viewed as a side cross section. The front wall 50 and the rear wall 51 are located to face with each other via a certain interval. The length of each of the front wall 50 and the rear wall 51 in the up and down direction is, for example, 2 to 10 cm, and preferably is 3 to 7 cm.

At the lower end part of the front wall 50, the reservoir side supply opening 57 and the reservoir side recovery opening 58 are formed in the front wall 50. On the front surface of the rear wall 51, the sending carrying substrate 26 is integrally formed. On the rear surface of the front wall 50, the returning carrying substrate 46 is integrally formed.

The reservoir side supply opening 57 is formed to penetrate through the right end part of the front wall 50 in the front and rear direction. The reservoir side recovery opening 58 is formed to penetrate through the left end part of the front wall 50 in the front and rear direction so as to secure a certain interval with respect to the reservoir side supply opening 57.

The sending carrying substrate 26 is a plate-like member having the length in the left and right direction substantially equal to the length of the development roller 24 in the left and right direction. Further, the sending carrying substrate 26 has the size in the up and down direction corresponding to the size of the rear wall 51 in the up and down direction. That is, the sending carrying substrate 26 is formed to have a vertical carrying part extending in the up and down direction.

The length of the sending carrying substrate 26 is, for example, 2 to 10 cm, and preferably is 3 to 7 cm. If the length of the sending carrying substrate 26 is shorter than 2 cm, the toner not properly charged tends to be mixed into the toner properly charged, which is undesirable. On the other hand, if the length of the sending carrying substrate 26 is longer than 10 cm, a demerit that the size of the toner supply unit 21 becomes too large occurs although in this case a merit that the toner not properly charged can be securely removed is achieved.

The sending carrying substrate 26 includes a plurality of carrying electrodes 64 and a plurality of insulating parts 65. Each of the plurality of carrying electrodes 64 is formed to be a linear pattern extending in the left and right direction, and the plurality of carrying electrodes 64 are arranged in the up and down direction at certain intervals. The plurality of carrying electrodes 64 are connected to a power supply unit (not shown) which supplies a voltage at predetermined timing to the plurality of electrodes 64.

Each of the insulating parts 65 is provided between adjacent ones of the plurality of carrying electrodes 64 so as to provide electrical isolation between adjacent ones of the plurality of carrying electrodes 64.

Similarly to the sending carrying substrate 26, the returning carrying substrate 46 is formed as an electric field carrying substrate. The returning carrying substrate 46 is formed to be a plate-like member having the length in the left and right direction substantially equal to the length of the development roller 24 in the left and right direction. The size of the returning carrying substrate 46 in the up and down direction is substantially equal to the size of the front wall 50 in the up and down direction. The upper end of the returning carrying substrate 46 is located to face the front end of the development roller 24 via a certain interval in the horizontal direction, and the lower end of the returning carrying substrate 46 is located to face the front end of the second screw 25 via a certain interval in the horizontal direction. In this configuration, the returning carrying substrate 46 carries the toner from the upper side to the lower side through an electrostatic force.

The bottom wall 52 is formed to have a semispherical shape when viewed as a side cross section so that the upper side thereof is opened. The rear end of the bottom wall 52 connects with the lower end of the rear wall 51, and the front end of the bottom wall 52 connects with the lower end of the front wall 50.

The top wall 53 is formed to have a semispherical shape when viewed as a side cross section so that the lower side thereof is opened. The rear end of the top wall 53 connects with the upper end of the rear wall 51, and the front end of the top wall 52 connects with the upper end of the front wall 50. Further, in the rear half part of the top wall 52, the opening is formed to be opened toward the photosensitive drum 18.

The toner reservoir 22 is formed as a part in the casing 43 surrounded by the lower end part of the front wall 50, the bottom wall 52, the lower end part of the rear wall 51. In the toner reservoir 22, the second screw 22 is provided to extend in the left and right direction.

The second screw 25 faces the lower end part of the front wall 50 and the lower end part of the rear wall 51 in regard to the front and rear direction. The second screw 25 is positioned to be parallel with the development roller 24 via a certain interval with respect to the development roller 24. The second screw 25 includes a spiral part 54 and a pair of support units 55 provided at ends in the left and right direction.

Figure 4:
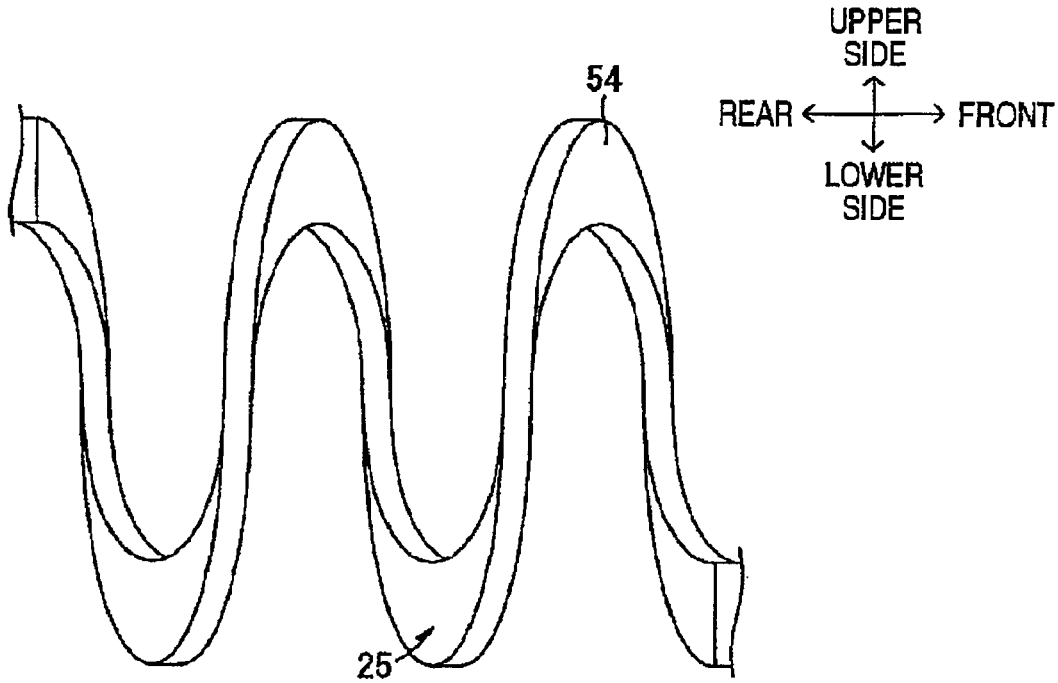
FIG. 4 is a front view of a spiral part of a second screw shown in FIG. 3.

As shown in FIG. 4, the spiral part 54 is formed of a coil spring like member, and is formed to have a spiral shape extending in the left and right direction. That is, when viewed as a side view, the spiral spring 54 has a ring shape.

The support units 55 are cylindrical members extending toward the outside in the left and right direction from the right and left ends of the spiral part 54, respectively. That is, the support units 55 are provided at the ends of the spiral part 54 in the left and right direction so as to have a common center axis with respect to the center axis of the spiral part 54. The support units 55 are provided to penetrate through the side walls of the casing 43 in the left and right direction so that the support units 55 are rotatably supported by the casing 43.

At the right support unit 55, a second screw drive gear 56 is provided on the outside of the right end of the casing 43 so as not to be relatively rotatable.

On the left support unit 55, a toner recovery blade 63 is provided to face the reservoir side recovery opening 58 at the left end in the inside of the casing 43. The toner recovery blade 63 is a plate-like member formed to extend on one side in a radial direction of the support unit 55.

The toner supply chamber 23 is formed such that the upper part thereof has a rectangular shape when viewed as a side view, and the area of the opening defined as a cross section viewed from the top side decreases gradually from the upper side to the lower side. That is, the toner supply chamber 23 is a box-like member having a trapezoidal shape when viewed as a side cross section. The lower end part of the toner supply chamber 23 is formed to have a curved shape so that the first screw 27 is accommodated. Further, the lower end part of the toner supply chamber 23 is formed to be a semispherical shape which is symmetrical with the bottom wall 52 of the casing 43 with respect to the reservoir side supply opening 57 and the reservoir side recovery opening 58.

At the lower end part of the toner supply chamber 23, the first screw 27 is provided to extend in the left and right direction. The ends of the first screw 27 in the left and right direction are formed to penetrate through the left and right walls of the toner supply chamber 23 so that the ends of the first screw 27 are supported by the right and left walls of the toner supply chamber 23 to be rotatable. Further, the first screw 27 is aligned with respect to the second screw 25 in the front and rear direction to be parallel with the second screw 25.

At the left end of the first screw 27, a first screw drive gear 61 is provided on the outside of the left end of the toner supply chamber 23 so as not to be relatively rotatable. The first screw drive gear 61 engages with the second screw drive gear 56 from the front side.

On the right end of the first screw 27, a toner supply blade 62 is provided in the inside of the right end part of the toner supply chamber 23 to face the supply chamber side supply opening 59. The toner supply blade 62 is formed to be a plate-like member extending, on one side, in a radial direction.

The toner supply chamber 23 is formed to communicate with the toner reservoir 22 such that the supply chamber side supply opening 59 faces the reservoir side supply opening 57, and the supply chamber side recovery opening 60 faces the reservoir side recovery opening 58.

When a driving force is transmitted from a motor (not shown) to the second screw drive gear 56 in the body casing 2, the second screw drive gear 56 rotates and the second screw 25 rotates. At the same time, the driving force is transmitted to the first screw drive gear 61 which engages with the second screw drive gear 56, and the first screw 27 rotates.

Then, the toner stored in the toner supply chamber 23 is carried, by rotation of the first screw 27, from the leftward supply chamber side recovery opening 60 to the rightward supply chamber side supply opening 59, and then is carried from the front side to the rear side by rotation of the toner supply blade 62 at the right end part of the toner supply chamber 23.

As a result, the toner is supplied to the toner reservoir 22 while passing through the supply chamber side supply opening 59 and the reservoir side supply opening 57 from the front side to the rear side.

Then, the toner supplied to the toner reservoir 22 is carried, by rotation of the second screw 5, from the rightward reservoir side supply opening 57 to the leftward reservoir side recovery opening 58, and then is carried, by rotation of the toner recovery blade 63, from the rear side to the front side in the left end part of the toner reservoir 22. Thus, the toner is recovered into the toner supply chamber 23 by passing through the reservoir side recovery opening 58 and the supply chamber side recovery opening 60 from the rear side to the front side.

The toner recovered into the toner supply chamber 23 is carried again by rotation of the first screw 27 from the leftward supply chamber side recovery opening 60 to the rightward supply chamber side supply opening 59. Thus, the toner stored in the toner supply chamber 23 is circulated between the toner supply chamber 23 and the toner reservoir 22.

By thus circulating the toner repeatedly, the top level (hereafter, referred to as a toner level) of the toner stored in the toner reservoir 22 is stably kept at a position lower then the upper end of the second screw 25 and at which (the position indicated by a dashed line L in FIG. 2) the top of the toner faces the rear wall 51 in the front and rear direction.

While the toner level L is stably kept, the toner at a midway point from the reservoir side supply opening 57 to the reservoir side recovery opening 58 (i.e., the toner being carried from the reservoir side supply opening 57 to the reservoir side recovery opening 58) is carried from the lower side to the upper side by the sending carrying substrate 26.

Hereafter, carrying of the toner by the sending carrying substrate 26 is explained in detail.

In order to carry the toner along the sending carrying substrate 26, a voltage is applied to a lower carrying electrode 64. In this case, an electric field is generated around the lower carrying electrode 64, and the toner is collected around the lower carrying electrode 64.

Then, a voltage is applied to an upper carrying electrode 64, and application of the voltage to the lower carrying electrode 64 is released. As a result, the electric field generated around the lower carrying electrode 64 disappears, and an electric field is generated around the upper carrying electrode 64. As a result, the toner collected around the lower carrying electrode 64 is attracted toward the upper carrying electrode 64, and moves to the upper carrying electrode 64.

By repeatedly altering application of the voltage and releasing of the voltage with respect to the carrying electrodes 64 of the sending carrying substrate 26 in regard to the up and down direction (e.g., by generating a traveling electric field along the sending carrying substrate 26), the toner is carried from the lower side to the upper side in the up and down direction by the electric field which appears or disappears in accordance with the voltage application to the carrying electrodes 64. The toner not properly charged (e.g., inversely charged toner or not charged toner) mixed into the toner being carried upward is shook off from the sending carrying substrate 64 by its own weight toward the toner reservoir 22.

Then, the toner which has carried to the upper end of the sending carrying substrate 26 jumps from the sending carrying substrate 26 to the development roller 24 through an electrostatic force pointing from the sending carrying substrate 26 to the development roller 24.

Thereafter, the toner jumps from the development roller 24 to the photosensitive drum 18 through an electrostatic force pointing from the development roller 24 to the photosensitive drum 24, and is supplied to the electrostatic latent image on the outer circumferential surface of the photosensitive drum 18.

On the other hand, the toner not carried by the sending carrying substrate 26 is carried from the right side to the left side in the toner reservoir 22 by rotation of the second screw 25. Then, the toner is recovered into the toner supply chamber 23 by passing through the reservoir side recovery opening 58 and the supply chamber side recovery opening 60.

The application of a voltage and releasing of a voltage with respect to the returning carrying substrate 46 is controlled such that the returning carrying substrate 46 carries the toner in the direction opposite to the carrying direction of the toner by the sending carrying direction 26.

The toner not supplied from the development roller 24 to the electrostatic latent image on the outer circumferential surface of the photosensitive drum 18 jumps from the development roller 24 to the returning carrying substrate 46 while receiving an electrostatic force pointing from the development roller 24 to the returning carrying substrate 46 when the toner faces the returning carrying substrate 46 by rotation of the development roller 24. Thereafter, the toner is carried from the upper side to the lower side along the returning carrying substrate 46, and is returned to the toner reservoir chamber 22.

Hereafter, advantages of the above described embodiment are described.

(1) As shown in FIGS. 2 and 3, in the toner supply unit 21, the first screw 27 carries the toner from the supply chamber side recovery opening 60 to the supply chamber side supply opening 59, and supplies the toner to the second screw 25 through the supply chamber side supply opening 59 and the reservoir side supply opening 57. The second screw 25 carries the toner from the reservoir side supply opening 57 to the reservoir side recovery opening 58, and then the toner is recovered into the toner supply chamber 23 via the reservoir side recovery opening 58 and the supply chamber side recovery opening 60.

Therefore, it is possible to circulate the toner between the toner supply chamber 23 and the toner reservoir 22. As a result, the toner can be supplied from the toner supply chamber 23 to the toner reservoir 22 via the supply chamber side supply opening 59 and the reservoir side supply opening 57 so that the amount of toner in the toner reservoir 22 is not reduced with respect to a predetermined amount. Further, the toner can be recovered from the toner reservoir 22 into the toner supply chamber 23 via the reservoir side recovery opening 58 and the supply chamber side recovery opening 60 so that the amount of toner in the toner reservoir 22 does not increase with respect to the predetermined amount. As a result, it becomes possible to keep the amount of toner in the toner reservoir 22 constant, and thereby to keep the toner level L in the toner reservoir 22 constant.

The sending carrying substrate 26 carries, from the lower side to the upper side, the toner at a midway point of the carrying path form the reservoir side supply opening 57 to the reservoir side recovery opening 58, and supplies the toner to the development roller 24. As a result, the sending carrying substrate 26 is able to carry the toner in the toner reservoir 22 from the lower side to the upper side in a state where the toner level L is kept constant in the toner reservoir 22.

Consequently, it becomes possible to keep a carrying distance of the toner by the sending carrying substrate 26 at a constant value, and thereby to stably shake off the toner not properly charged while the toner is carried.

(2) As shown in FIGS. 2 and 3, the first screw 27 and the second screw 25 are aligned in the front and rear direction to be parallel with each other. Therefore, it becomes possible to circulate the toner in the front and rear direction horizontally. As a result, it becomes possible to keep the toner level L constant more stably in the toner reservoir 22.

(3) In the toner supply unit 21, the sending carrying substrate 26 carries the toner in the up and down direction. Therefore, it is possible to securely shake off the toner along the up and down direction.

(4) In the toner supply unit 21, the toner level L is defined at the position lower than the upper end of the second screw 25. Therefore, it becomes possible to securely carry the toner by the second screw 25.

The position of the toner level L faces, in the front and rear direction, the front surface of the rear wall 51 of the casing 43 which is formed straight when viewed as a side view. Therefore, it becomes possible to keep the toner level L in the vicinity of the front surface of the rear wall 51 of the casing 43 constant.

(5) The second screw 25 has a circular shape when viewed as a side view, and has the spiral part 54 extending in the left and right direction. That is, the spiral part 54 of the second screw 25 has a form of a coil spring extending in the left and right direction. Therefore, by rotating the second screw 25 in the circumferential direction of the spiral part 54, it becomes possible to prevent the toner from scattering in the circumferential direction, and thereby it becomes possible to carry the toner in the left and right direction while preventing fluctuation of the toner level L by rotation of the second screw 54 in the toner reservoir 22. As a result, it becomes possible to carry the toner in the left and right direction while keeping the toner level L constant in the toner reservoir 22.

(6) In the toner supply unit 21, the reservoir side supply opening 57 and the supply chamber side supply opening 59 are aligned in the front and rear direction to be parallel with each other via a certain interval, and/or the reservoir side recovery opening 58 and the supply chamber side recovery opening 60 are aligned in the front and rear direction to be parallel with each other via a certain interval.

Therefore, it becomes possible to supply the toner to the toner reservoir 22 and to recover the toner from the toner reservoir 22 horizontally in the front and rear direction. Consequently, it becomes possible to securely keep the toner level L constant in the toner reservoir 22.

(7) The laser printer 1 is provided with the above described toner supply unit 21. Therefore, the laser printer 1 is able to shake off the toner not properly charged in the toner supply unit 21, and thereby to form an image having an excellent quality.

(8) The laser printer 1 includes the toner supply unit 21 for each of the photosensitive drums 18, and transfers primarily an image to the intermediate transfer belt 30, and then transfers secondarily the toner image from the intermediate transfer belt 30 to the sheet of paper P. Since the toner not properly charge is shook off from a carrying path, it becomes possible to achieve the image formation employing the intermediate transferring.

Figure 5:
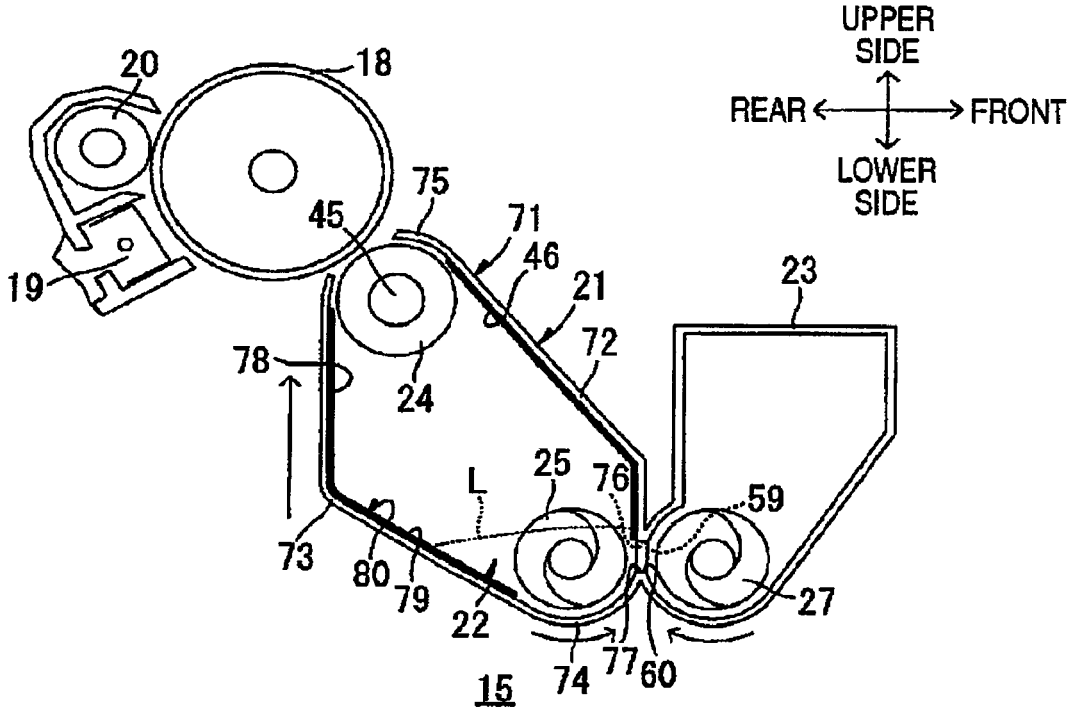
FIG. 5 is a side cross section of a process unit according to a first variation of the first embodiment.

Hereafter, a first variation of the toner supply unit is described with reference to FIG. 5. In FIG. 5, to elements which are substantially the same as those of the above described first embodiment, the same reference numbers are assigned and explanations thereof will not be repeated for the sake of simplicity. In the following, the explanations focus on the feature of the first variation.

In the above described first embodiment, the development roller 24 and the second screw 25 are aligned in parallel with each other in the up and down direction, the casing 43 is formed to extend in the up and down direction and the left and right direction, and the casing 43 is formed to have a box-shape of which upper and lower end parts are formed to be semispherical shapes when viewed as a side view.

However, the shape of the casing 43 is not limited to the shape described in the first embodiment. Therefore, as shown in FIG. 5, the development roller 24 and the second screw 25 may be aligned along a direction extending upward and obliquely to be parallel with each other while securing a certain interval therebetween. As shown in FIG. 5, a casing 71 may be formed to have a rhombic shape when viewed as a side view.

As shown in FIG. 5, the casing 71 includes a front wall 72, a rear wall 73, a bottom wall 74 and a top wall 75. The right and left ends of the casing 71 are closed by a pair of side walls. The front wall 72 has a form of a letter "V" opened downward in a slanting direction, and is formed to be inclined downward toward the front side. The front end of the front wall 72 is bent downward. At the front end of the front wall 72, a reservoir side supply opening 76 and a reservoir side recovery opening 77 are formed.

The reservoir side supply opening 76 is formed to penetrate through the right end part of the front wall 72. The reservoir side recovery opening 77 is located at the left end part of the front wall 72 to have a certain interval with respect to the reservoir side supply opening 76. That is, the reservoir side recovery opening 77 is formed to penetrate through the left end part of the front wall 77.

The rear wall 73 has a form of a letter "V" opened upward in a slanting direction. More specifically, the rear wall 73 has an upper half part extending upward and straight in the up and down direction when viewed as a side view, and a lower half part extending downward and straight in a slanting direction toward the front side when viewed as a side view. The lower half part of the rear wall 73 faces the second screw 25.

The length of the upper half part of the rear wall 73 is, for example, 2 to 10 cm, and preferably is 3 to 7 cm. On the front surface (inner surface) of the rear wall 73, a sending carrying substrate 80 is integrally formed.

The sending carrying substrate 80 is a plate-like member having substantially the same length in the left and right direction as that of the development roller 24, and is formed to expand across the rear wall 73 in the up and down direction.

More specifically, the sending carrying substrate 80 has a vertical part 78 provided on the upper half part of the rear wall 73 and a slanting part 79 formed on the lower half part of the rear wall 73.

The vertical part 78 extends in the up and down direction, and the upper end thereof faces the rear edge of the development roller 24 in the front and rear direction. The slanting part 79 is formed to be continuously connected to the lower end of the vertical part 78, and is formed to be inclined downward toward the front side. The lower end part of the slanting part 79 faces the rear end of the second screw 25 via a certain interval in the front and rear direction.

The length of the vertical part 78 of the sending carrying substrate 80 is, for example, 2 to 10 cm, and preferably is 3 to 7 cm. If the length of the vertical part 78 in the up and down direction is shorter than 2 cm, the toner not properly charged tends to be mixed into the toner properly charged and is supplied to the photosensitive drum 18, which is undesirable. On the other hand, if the length of the vertical part 78 is longer than 10 cm, a demerit that the size of the toner supply unit 21B becomes too large occurs although in this case a merit that the toner not properly charged can be securely removed is achieved.

The bottom wall 74 has a shape of a circular arc opened toward the upper side when viewed as a side view. The bottom wall 74 is formed such that the rear end of the bottom wall 74 is continuously connected to the lower end of the rear wall 73, and the front end of the bottom wall 74 is continuously connected to the lower end of the front wall 72.

The top wall 75 has a shape of a circular arc opened toward the lower side when viewed as a side view. The top wall 75 is formed such that the rear end of the top wall 75 is continuously connected to the upper end of the rear wall 73, and the front end of the top wall 75 is continuously connected to the upper end of the front wall 72. The opening is formed in the rear half part of the top wall 75.

In the casing 71, the development roller 24 is provided to extend in the left and right direction in a portion surrounded by the upper end part of the front wall 72, the top wall 75, and the upper end part of the rear wall 73.

A portion surrounded by the lower end part of the front wall 72, the bottom wall 74 and the lower end part of the rear wall 73 is formed as the toner reservoir 22.

By repeatedly circulating the toner between the toner supply chamber 23 and the toner reservoir 22, it becomes possible to keep the top level of the toner (i.e., the toner level) constant in the toner reservoir 22 at the position which is lower than the upper end of the second screw 25 and faces the front surface of the lower half part of the rear wall 73 (i.e., the position indicated by a dashed line in FIG. 5).

At a midway point of the path from the reservoir side supply opening 76 to the reservoir side recovery opening 77, the toner is carried upward in a slanting direction along the slanting part 79, and then is carried upward in the up and down direction by the vertical part 78 to be supplied to the development roller 24. In this case, the toner not properly charged being carried upward in the up and down direction by the vertical part 78 is shook off from the vertical part 78 by its own weight.

It is understood that, according to the first variation, the same advantages as those achieved by the above described first embodiment can be achieved.

Figure 6:
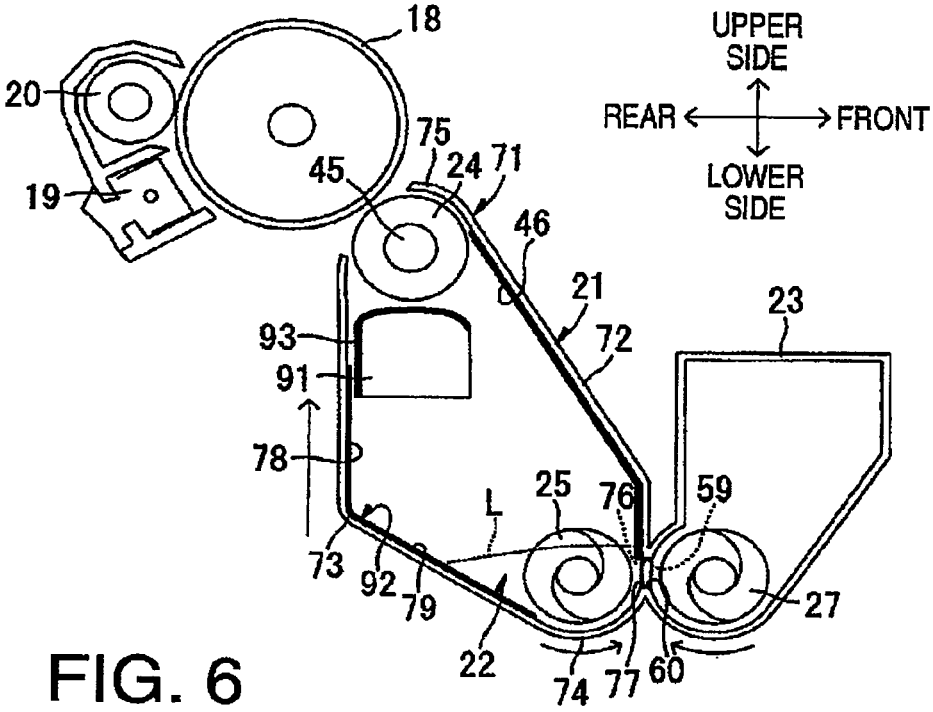
FIG. 6 is a side cross section of a process unit according to a second variation of the first embodiment.

Hereafter, a second variation of the toner supply unit is described with reference to FIG. 6. In FIG. 6, to elements which are substantially the same as those of the above described first embodiment and the first variation, the same reference numbers are assigned and explanations thereof will not be repeated for the sake of simplicity. In the following, the explanations focus on the feature of the second variation.

In the above described first variation, the sending carrying substrate 80 is formed throughout the length of the rear wall 73 in the up and down direction. However, the sending carrying substrate may not be formed throughout the length of the rear wall 73 in the up and down direction, and the sending carrying substrate may not have an integrated structure. That is, as shown in FIG. 6, a first sending carrying substrate 92 having an integrated structure may be provided such that the upper end of the first sending carrying substrate 92 is located at a substantially central portion of the rear wall 73 in the up and down direction so as not to face the development roller 24. In the casing 71, an intermediate carrying unit 91 may be located under the development roller 24 to face the lower edge of the development roller 24 in the up and down direction and to face the upper end part of the first sending carrying substrate 92 in the front and rear direction.

The intermediate carrying unit 91 is formed such that the upper end part thereof is curved to have a shape of a letter "U", and wholly has a rectangular shape. Further, the intermediate carrying unit 91 has a second sending carrying substrate 93.

The second sending carrying substrate 93 is formed to cover the entire upper surface and the rear surface of the intermediate carrying unit 91. More specifically, the second sending carrying substrate 93 extends upward from the lower end to the upper end of the intermediate carrying unit 91, and then extends toward the front side to reach the front end of the upper surface of the intermediate carrying unit 91. A part of the second sending carrying substrate 93 covering the upper surface of the intermediate carrying unit 91 faces the development roller 24 in the up and down direction.

The first sending carrying substrate 92 has the vertical part 78 provided on the upper half part of the rear wall 73, and the slanting part 79 provided on the lower half part of the rear wall 73.

The vertical part 78 extends in the up and down direction, and the upper end thereof faces the lower end of the second sending carrying substrate 93 at the central portion of the rear wall 73 in the up and down direction to have a certain interval with respect to the lower end of the second sending carrying substrate 93. The slanting part 79 is formed to be continuously connected to the lower end of the vertical part 78, and is formed to be inclined downward toward the front side. The lower end of the slanting part 79 faces the rear end of the second screw 25 via a certain interval in the front and rear direction.

In the image formation operation, at a midway point of the carrying path along which the toner proceeds from the reservoir side supply opening 76 to the reservoir side recovery opening 77, the toner is carried upward in a slanting direction along the slanting part 79, and then is carried upward along the vertical part 78. Then, at the upper end of the vertical part 78, the toner jumps from the vertical part 78 to the second sending carrying substrate 93 through an electrostatic force pointing from the vertical part 78 to the second sending carrying substrate 93.

Then, the toner is carried upward by the second sending carrying substrate 93, and is carried toward the front side. Then, at a midway point of the carrying path along which the toner is carried toward the front side, the toner faces the lower surface of the development roller 24, and jumps from the second sending carrying substrate 93 to the development roller 24. Thus, the toner is supplied to the development roller 24.

According to the second variation, even if the vertical part 78 of the second variation is formed to be shorter than the vertical part 78 of the first variation, the toner not properly charged can be shook off when the toner jumps from the vertical part 78 to the second sending carrying substrate 93 or when the toner is carried upward along the second sending carrying substrate 93.

It is understood that, according to the second variation, the same advantages as those achieved by the above described first embodiment can be achieved.

Figure 7:
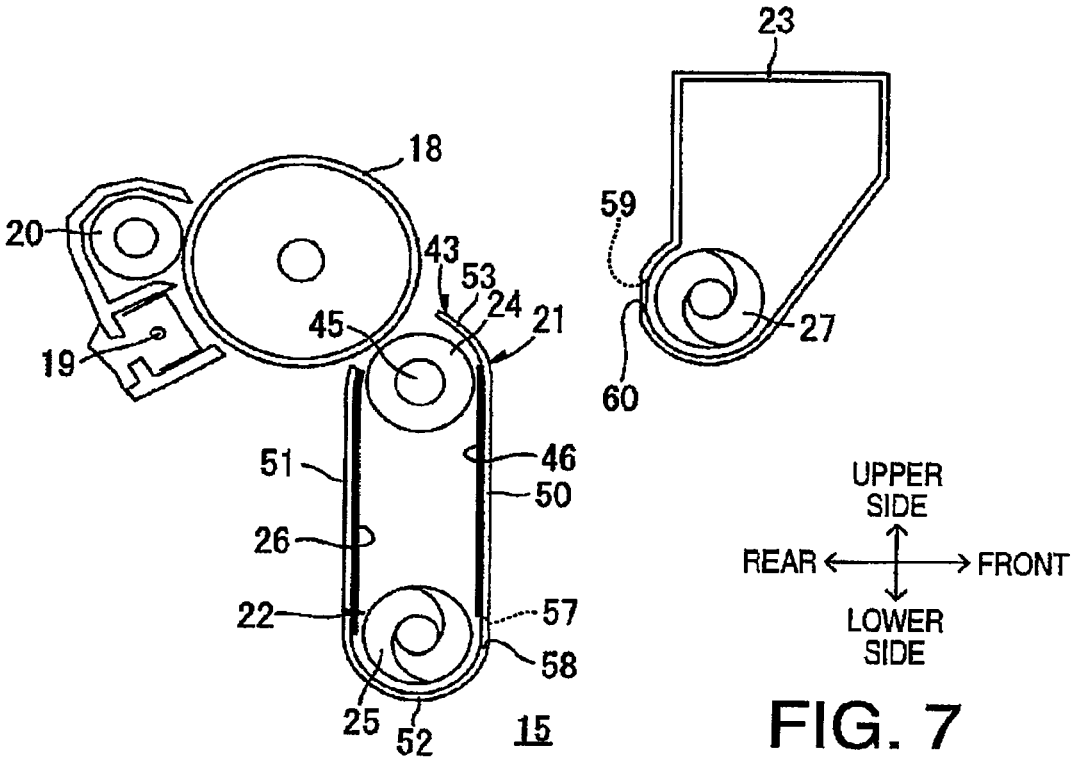
FIG. 7 is a side cross section of a process unit according to a third variation of the first embodiment.

Hereafter, a third variation of the toner supply unit is described with reference to FIG. 7. In FIG. 7, to elements which are substantially the same as those of the above described first embodiment, the same reference numbers are assigned and explanations thereof will not be repeated for the sake of simplicity. In the following, the explanations focus on the feature of the third variation.

In the above described first embodiment, the toner supply chamber 23 is fixed to the toner reservoir 22. However, the toner supply chamber 23 may be formed to be detachably attachable to the toner reservoir 22 as shown in FIG. 7. In this case, a shutter member may be may be provided to cover each of the supply opening and the recovery opening of each of the toner reservoir 22 and the toner supply chamber 23.

According to the third variation, it is possible to achieve the same advantages as those achieve by the first embodiment.

Figure 8:
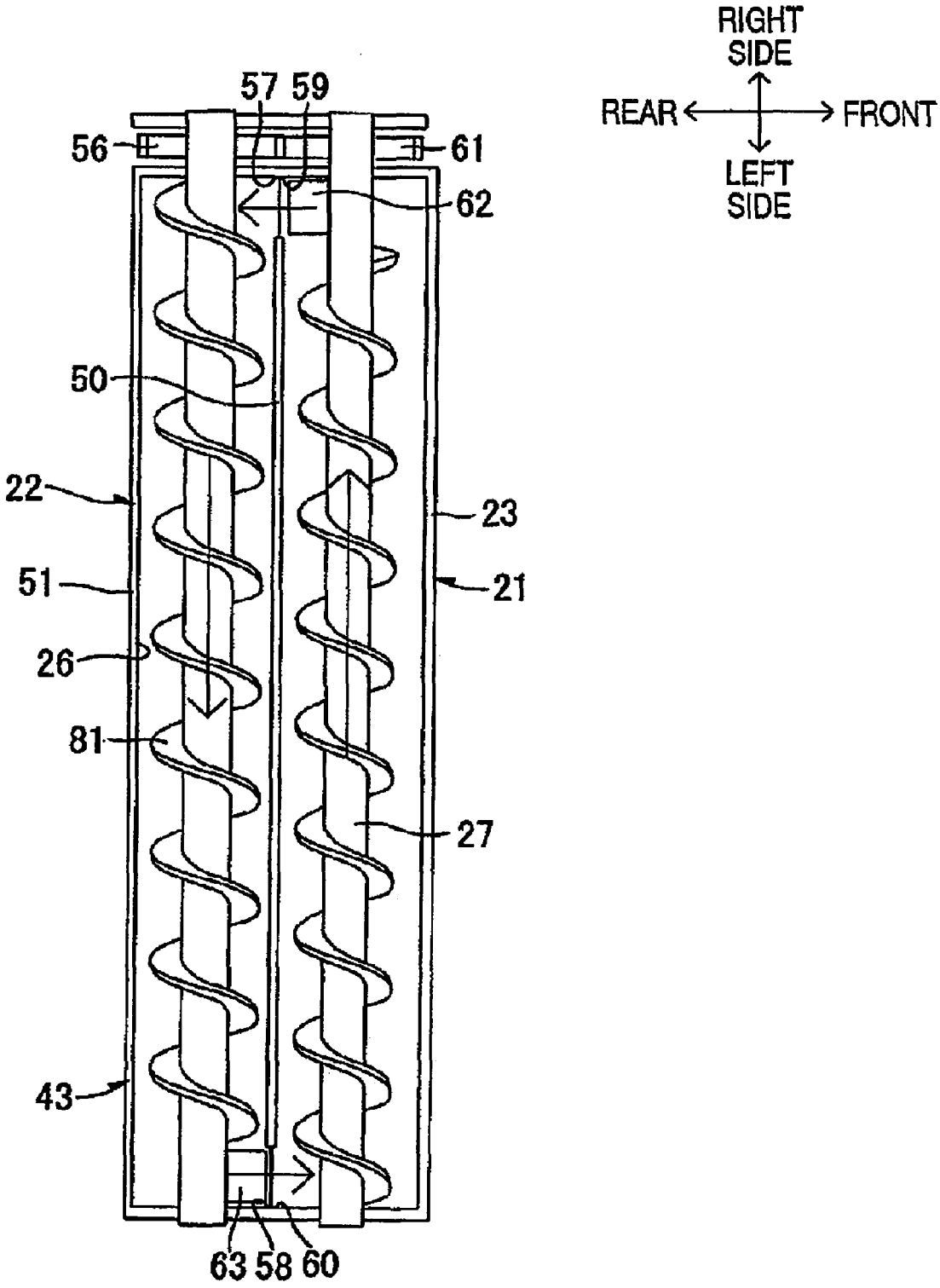
FIG. 8 is a plane cross section illustrating a variation of the second screw.

In the above described first embodiment, the second screw 25 is formed to have a shape of a coil spring. However, the second screw 25 may be formed to have a shape of a screw having a shaft as shown in FIG. 8 (see a second screw 81). As shown in FIG. 8, at the right end of the second screw 81, a second screw drive gear 56 is provided, on the outside of the right end of the toner supply chamber 23, so as not to be relatively rotatable.

On the left end of the second screw 81, the toner supply blade 63 is provided to face the reservoir side recovery opening 58, in the inside of the left end part of the toner supply chamber 23. The toner supply blade 62 is a plate-like member extending on one side in the radial direction of the second screw 81.

Second Embodiment

Hereafter, a laser printer 1B according to a second embodiment is described. In the following, to elements which are substantially the same as those shown in the first embodiment, same reference numbers are assigned, and explanations thereof will not be repeated for the sake of simplicity. In the following, the explanations focus on the feature of the second embodiment.

Figure 9:
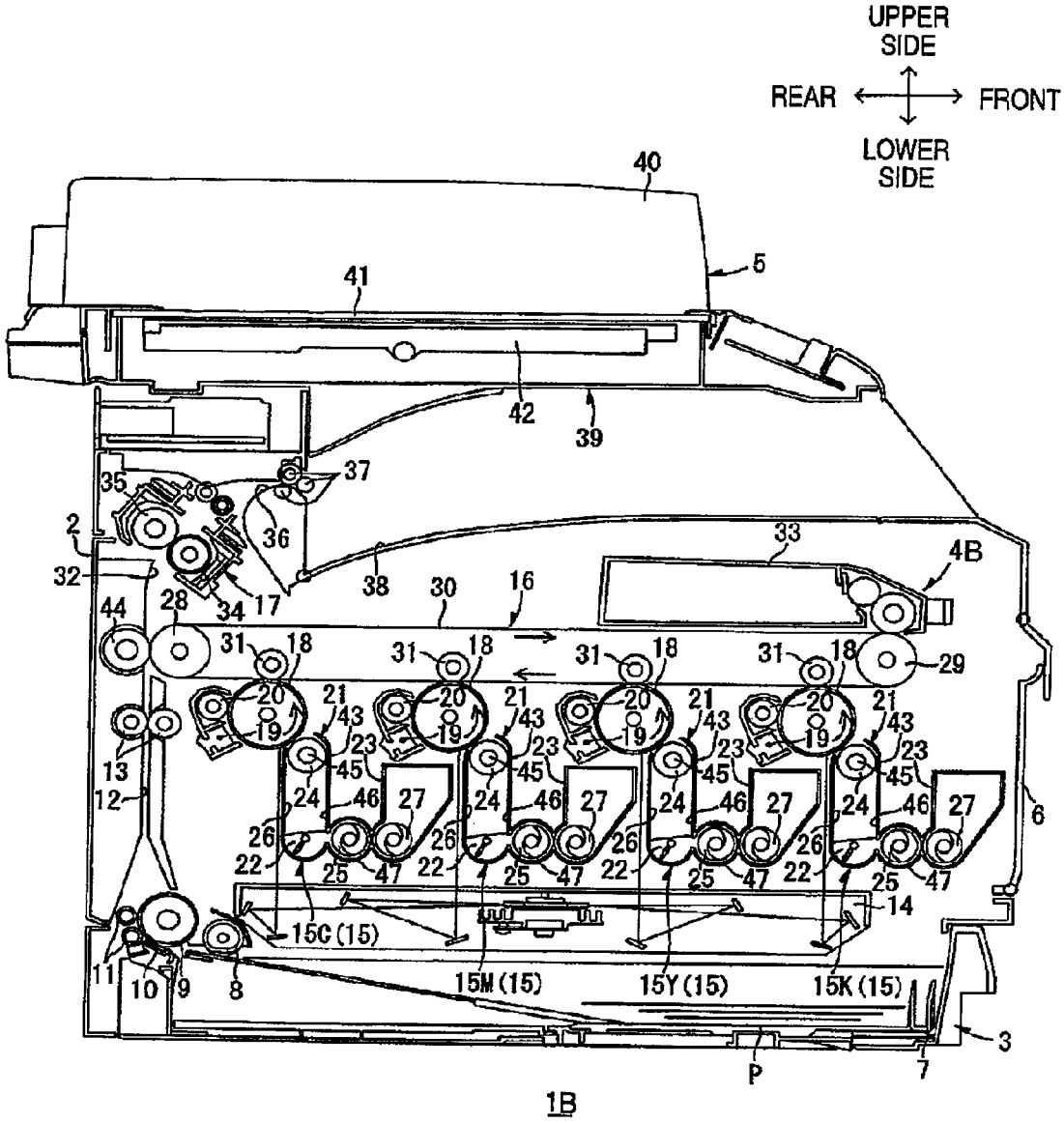
FIG. 9 is a side cross section of a laser printer according to a second embodiment.

As shown in FIG. 9, the laser printer 1B according to the second embodiment has substantially the same configuration as that of the first embodiment, and includes the body casing 2, the paper supply unit 3, an image formation unit 4B and the image reading unit 5.

The image formation unit 4B includes the scanning unit 14, four process units 15, the transfer unit 16 and the fixing unit 17. The process units 15 are provided respectively for four colors. More specifically, the process units 15 include a black process unit 1K, an yellow process unit 15Y, a magenta process unit 15M and a cyan process unit 15C, which are arranged in this order from the front side while securing certain intervals therebetween. Each of the process units 15 includes the photosensitive drum 18 (i.e., an image holding body), the scorotron charger 19, the cleaning roller 20 and a toner supply unit 21 (i.e., a development device).

Hereafter, the toner supply unit 21 according to the second embodiment is explained in detail.

Each photosensitive drum 18 is provided to extend in the left and right direction. The four photosensitive drums 18 are arranged in the front and rear direction at certain intervals. Each photosensitive drum 18 is rotated in the counterclockwise direction when viewed from the left side (see FIG. 1). The scorotoron charger 19 is provided under the rear part of the photosensitive drum 18 to face the photosensitive drum 18 at a certain interval. The cleaning roller 20 is provided on the rear side of the photosensitive drum 18 to face the photosensitive drum 18.

The four toner supply units 21 are provided respectively for the four photosensitive drums 18. Each toner supply unit 21 includes the casing 43, the toner reservoir 22 (i.e., a developer reservoir), a toner carry chamber 47, and the toner supply chamber 23 (i.e., a developer chamber).

The casing 43 is provided under the front end of the photosensitive drum 18. The casing 43 has a box-shape extending in the up and down direction excepting a part where the toner carry chamber 47 is provided. Each of the ends of the casing 43 defined in the up and down direction is formed to be a semispherical shape. The rear half part of the upper portion of the casing 43 is provided with an opening extending in the left and right direction so that the opening faces the photosensitive drum 18.

In the casing 43, a development roller 24 (i.e., a developer holding body), a sending carrying substrate 26 and a returning carrying substrate 27 are accommodated. The development roller 24 is a roller-like member having a cylindrical circumferential surface, and is provided to be rotatable about a rotation axis 45 extending in the left and right direction. The development roller 24 is provided above the toner reservoir 22 at the upper end portion of the casing 43 so that the upper part thereof is exposed to the outside through the opening of the casing 43. The development roller 24 faces the photosensitive drum 18 from the obliquely defined lower side through the opening of the casing 43.

The sending carrying substrate 26 is provided integrally with an inner wall of a rear wall 51 of the casing 43, and the upper end of the sending carrying substrate 26 faces the rear end of the development roller 24 via a certain interval formed in the front and rear direction. The sending carrying substrate 26 is provided to extend in the up and down direction so that the lower end of the sending carrying substrate 26 faces a rear end of an unstiffening member 54 in the front and rear direction via a certain interval. As described later, the sending carrying substrate 26 carries the toner upward in the up and down direction through an electrostatic force.

The returning carrying substrate 46 is provided integrally with an inner wall of a front wall 51 of the casing 43 to extend in the up and down direction. As described in detail later, the returning carrying substrate 46 carries the toner held on the development roller 24 downward in the up and down direction with an electrostatic force to circulate the toner to the toner reservoir 22.

The toner reservoir 22 is provided at the bottom part of the casing 43 to store a predetermined amount of toner. Further, the toner reservoir 22 includes the unstiffening member 54 to unstiffen the toner. The unstiffening member 54 is provided throughout the left and right direction, and is configured to unstiffen the toner stored in the toner reservoir 22 by rotation thereof.

The toner carry member 47 has a cylindrical shape extending in the left and right direction, and is provided integrally with the casing 43. In the toner carry member 47, a second screw 25 (a second carrying member) is provided. As described in detail later, an opening 48 is formed in a part of the casing to communicate the toner carrying chamber 47 with the toner reservoir 22. The second screw 25 is provided in the toner carry chamber 47 to extend in the left and right direction. As described later, the second screw 25 carries the toner from the right side to the left side. A toner supply chamber 23 has a box-shape extending in the left and right direction, and is connected to the toner carry chamber 47 on the front side of the toner carry chamber 47.

As described in detail later, at a joint portion of the toner carry chamber 47 and the toner supply chamber 23, a carry chamber side recovery opening 58 and a supply chamber side recovery opening 60 are provided on the left side, and a carry chamber side supply opening 57 and a supply chamber side supply opening 59 are provided on the right side. The toner carry chamber 47 and the toner supply chamber 23 are connected to communicate with each other via the carry chamber side recovery opening 58 and the supply chamber side recovery opening 60 and via the carry chamber side supply opening 57 and the supply chamber side supply opening 59.

The toner supply chamber 23 is provided with a first screw 27 (i.e., a first carrying member). The first screw 27 is provided to extend in the left and right direction in the lower end part of the toner supply chamber 23. As described in detail later, the first screw 27 is formed to carry the toner from the left side to the right side.

Hereafter, a development process in the process unit 15 is described. The toner accommodated in the toner supply chamber 23 is carried from the lest side to the right side by rotation of the first screw 27, and then is supplied to the toner carry chamber 47 through the supply chamber side supply opening 59 and the carry chamber side supply opening 57. The toner which has supplied to the toner carry chamber 47 is carried from the right side to the left side in the toner carry chamber 47 by rotation of the second screw 25.

The toner being carried from the right side to the left side in the toner carry chamber 47 flows into the toner reservoir 22 at midway points along the carry path, and contacts the sending carrying substrate 26 in the toner reservoir 22. The toner contacting the sending carrying substrate 26 is applied an electrostatic force pointing from the lower side to the upper side by the sending carrying substrate 26, is carried from the lower side to the upper side along the sending carrying substrate 2, and faces the development roller 24 at the upper end part of the sending carrying substrate 26.

The toner facing the development roller 24 receives the electrostatic force pointing from the sending carrying substrate 26 to the development roller 24, jumps from the sending carrying substrate 26 to the development roller 24, and is held on the development roller 24.

The outer circumferential surface of the photosensitive drum 18 is charged uniformly and positively by the scorotoron charger 19. Then, the positively charged outer circumferential surface of the development roller 18 is scanned by the laser beam from the scanning unit 14 while the development roller 18 rotates. As a result, an electrostatic latent image (i.e., an image to be formed on the sheet of paper P) is formed on the outer circumferential surface of the photosensitive drum 18.

While the photosensitive drum 18 is rotated, the toner held on the development roller 24 reaches the position facing the electrostatic latent image on the photosensitive drum 18. At this time, the toner held on the development roller 24 receives the electrostatic force pointing from the development roller 24 to the electrostatic latent image, and jumps toward the electrostatic latent image. Thus, the toner is supplied to the electrostatic latent image formed on the outer circumferential surface of the photosensitive drum 18.

The toner facing parts of the outer circumferential surface of the photosensitive drum 18 where the electrostatic latent image is not formed receives an electrostatic force pointing from the photosensitive drum 18 to the development roller 24, and therefore is not supplied to the photosensitive drum 18, and remains on the outer surface of the development roller 24. The toner remaining on the outer surface of the development roller 24 is carried by the returning carrying substrate 46 to the toner reservoir 22. Thus, the electrostatic latent image is developed, and a toner image is held on the outer circumferential surface of the photosensitive drum 18.

Hereafter, the configuration of the process unit 15 according to the second embodiment is explained in detail.

Figure 10:
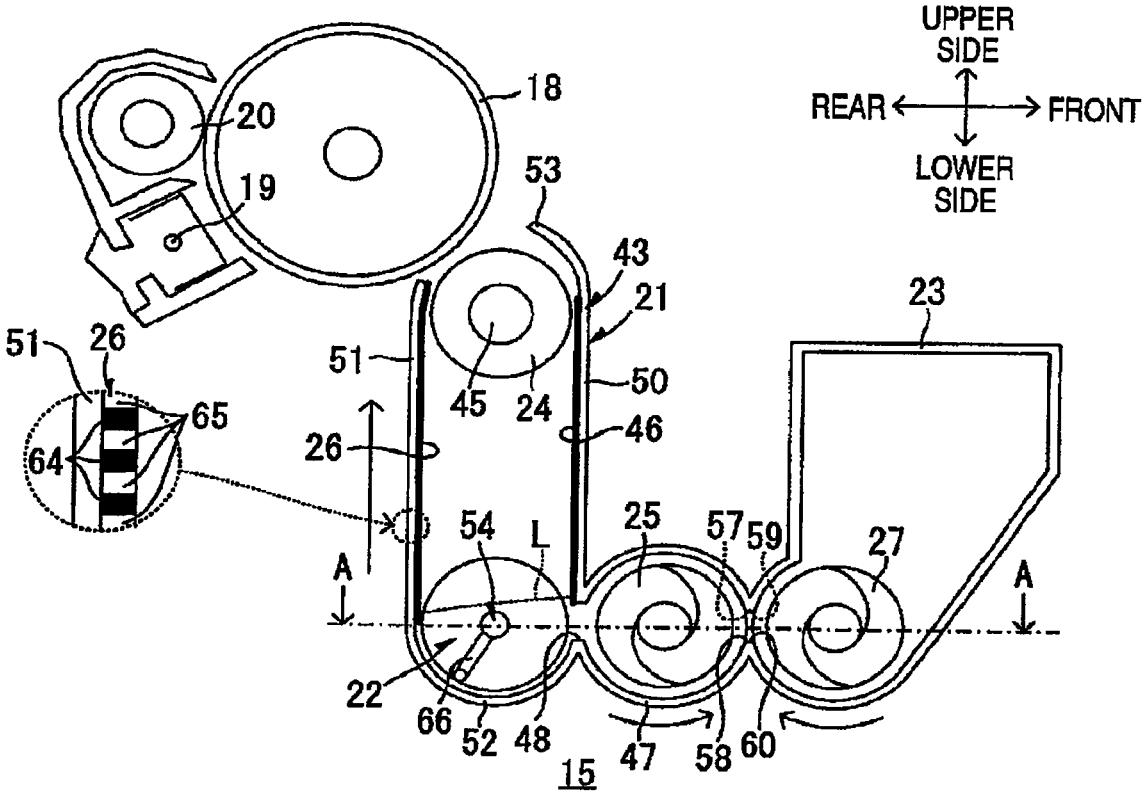
FIG. 10 is a side cross section of a process unit shown in FIG. 9.
Figure 11:
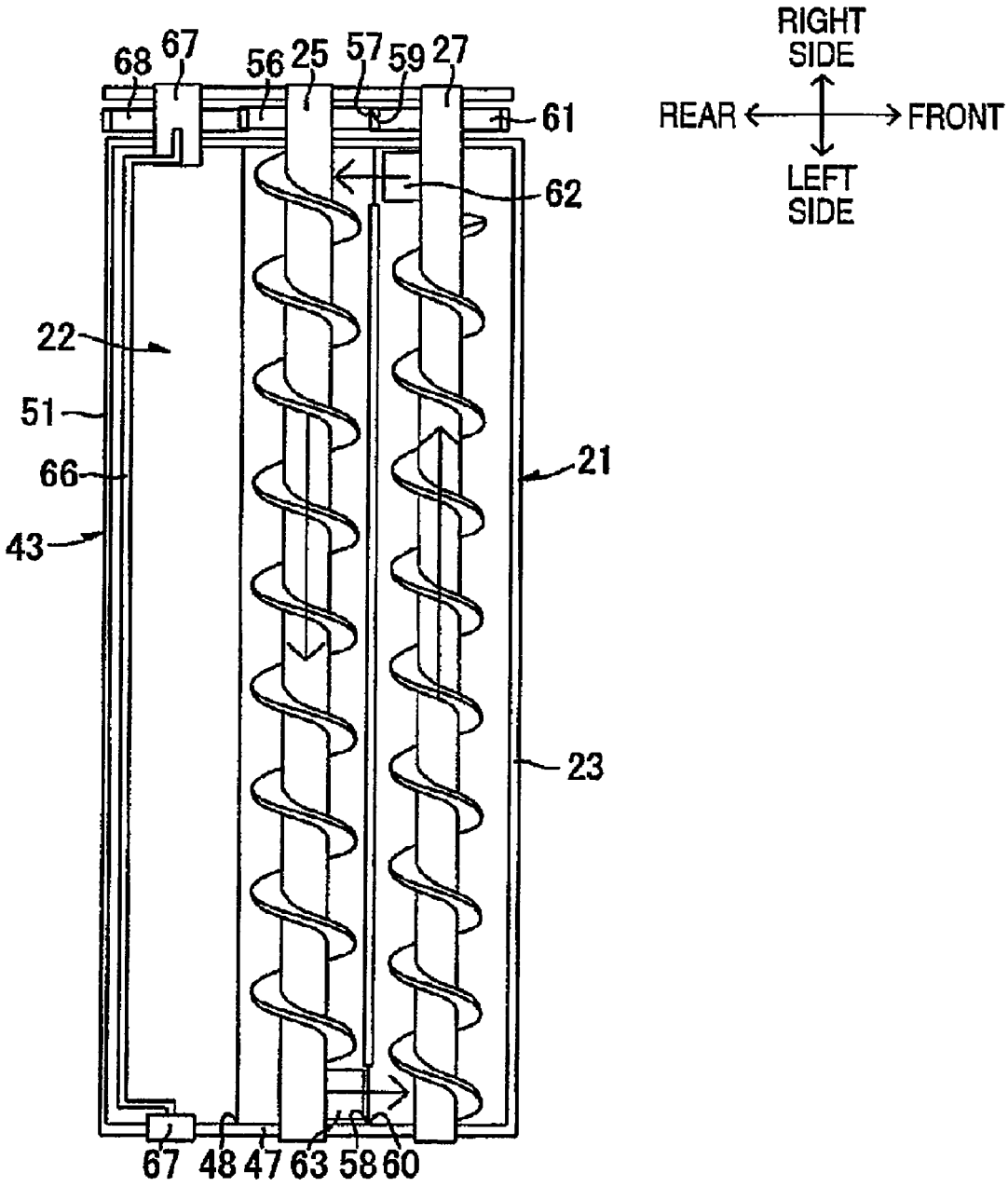
FIG. 11 is a cross sectional view of the process unit along a line A-A in FIG. 10.

As shown in FIGS. 10 and 11, the toner supply unit 21 includes the casing 43, the toner reservoir 22, the toner carry chamber 47 and the toner supply chamber 23.

The casing 43 has a front wall 50, a rear wall 51, a bottom wall 52 and a top wall 53. The ends of the casing 43 in the left and right direction are closed by a pair of side walls. Each of the front wall 50 and the rear wall 51 is elongated in the up and down direction, and is formed to be a plate-like member when viewed as a side cross section. The front wall 50 and the rear wall 51 are located to face with each other via a certain interval. The length of each of the front wall 50 and the rear wall 51 in the up and down direction is, for example, 2 to 10 cm, and preferably is 3 to 7 cm.

The opening 48 is formed in the lower end part of the front wall 50. The sending carrying substrate 26 is integrally provided with the front surface of the rear wall 52. On the rear surface of the front wall 50, a returning carrying substrate 46 is provided. The opening 48 is formed to have a rectangular shape 50 to penetrate through the front wall 50 in the front and rear direction throughout the left and right direction of the front wall 50.

The sending carrying substrate 26 is a plate-like member having the same length in the left and right direction as the length of the development roller 24 in the left and right direction, and is formed to have the size in the up and down direction substantially the same as that of the rear wall 51. That is, the sending carrying substrate 26 has a vertical carrying part extending in the up and down direction.

The length of the sending carrying substrate 26 in the up and down direction is, for example, 2 cm, and preferably is 3 to 7 cm. If the length of the sending carrying substrate 26 is shorter than 2 cm, the toner not properly charged tends to be mixed into the toner properly charged, which is undesirable. On the other hand, lithe length of the sending carrying substrate 26 is longer than 10 cm, a demerit that the size of the toner supply unit 21 becomes too large occurs although in this case a merit that the toner not properly charged can be securely removed is achieved.

The sending carrying substrate 26 includes a plurality of carrying electrodes 64 and a plurality of insulating parts 65. Each of the plurality of carrying electrodes 64 is formed to be a linear pattern extending in the left and right direction, and the plurality of carrying electrodes are arranged in the up and down direction at certain intervals. The plurality of carrying electrodes 64 are connected to a power supply unit (not shown) which supplies a voltage at predetermined timing to the plurality of electrodes 64.

Each of the insulating parts 65 is provided between adjacent ones of the plurality of carrying electrodes 64 so as to provide electrical isolation between adjacent ones of the plurality of carrying electrodes 64.

Similarly to the sending carrying substrate 26, the returning carrying substrate 46 is formed as an electric field carrying substrate. The returning carrying substrate 46 is formed to be a plate-like member having the length in the left and right direction substantially equal to the length of the development roller 24 in the left and right direction. The size of the returning carrying substrate 46 in the up and down direction is substantially equal to the size of the front wall 50 in the up and down direction. The upper end of the returning carrying substrate 46 is located to face the front end of the development roller 24 via a certain interval in the horizontal direction, and the lower end of the returning carrying substrate 46 is located on the upper side of the opening 48. In this configuration, the returning carrying substrate 46 carries the toner from the upper side to the lower side through an electrostatic force.

The bottom wall 52 is formed to have a semispherical shape when viewed as a side cross section so that the upper side thereof is opened. The rear end of the bottom wall 52 connects with the lower end of the rear wall 51, and the front end of the bottom wall 52 connects with the lower end of the front wall 50.

The top wall 53 is formed to have a semispherical shape when viewed as a side cross section so that the lower side thereof is opened. The rear end of the top wall 53 connects with the upper end of the rear wall 51, and the front end of the top wall 52 connects with the upper end of the front wall 50. Further, in the rear half part of the top wall 52, the opening is formed to be opened toward the photosensitive drum 18.

The toner reservoir 22 is formed as a part in the casing 43 surrounded by the lower end part of the front wall 50, the bottom wall 52, the lower end part of the rear wall 51. In the toner reservoir 22, the unstiffening member 54 is arranged along the left and right direction.

The unstiffening member 54 is arranged to face the lower end part of each of the front wall 50 and the rear wall 51 in the front and rear direction. The unstiffening member 54 includes a stirring part 66 and a pair of supporting parts 67.

The stirring part 66 is a rod-like member extending in the left and right direction, and is formed to be bent at right and left ends thereof to have a from of a letter "U". More specifically, the stirring part 66 is formed to extend in the left and right direction, and is bent at eight and left ends thereof and then to extend in directions perpendicular to the left and right direction. At the right and left end portions of the stirring member 66, each end in the direction perpendicular to the right and left direction is attached to the corresponding support part 67 so as not to be rotatable with respect to the support part 67.

The support parts 67 are provided to continuously connect to the right and left ends of the stirring part 66, respectively, and each of the support parts 67 is formed to have a cylindrical shape extending to the outside in the left and right direction. The support parts 67 are provided to penetrate through the right and left walls of the casing 43, respectively, so that the support parts 67 are rotatably supported by the right and left walls of the casing 43, respectively. On the rightward outside of the casing 43, a driving gear 68 is provided on the right support part 67 so as not to be rotatable relatively.

The toner carry chamber 47 is formed to have a cylindrical shape extending in the left and right direction, and is provided on the front side of the toner reservoir 22. The toner carry chamber 47 is provided integrally with the front wall 50 of the casing 43 such that the toner carry chamber 47 is continuously formed from the periphery of the opening 48. More specifically, the upper half of the toner carry chamber 47 is formed to be continuously connected to the upper edge of the opening 48, and the lower half of the toner carry chamber 47 is formed to be continuously connected to the lower edge of the opening 48. Further, the right and left ends of the toner carry chamber 47 are formed to be continuously connected to the right and left ends of the opening 48, respectively.

On the front side in the toner carry chamber 47, the carry chamber side supply opening 57 and the carry chamber side recovery opening 58 are formed. Further, in the toner carry chamber 47, the second screw 45 is provided to extend in the left and right direction. The carry chamber side supply opening 57 is formed to penetrate through the right end part of the toner carry chamber 47 in the front and rear direction. The carry chamber side recovery opening 58 is formed to penetrate the left end part of the toner carry chamber 47 to have a certain interval with respect to the carry chamber side supply opening 57 in the left and right direction.

The second screw 25 is provided to face the opening 48 in the front and rear direction, and left and right ends of the second screw 25 are formed to penetrate the right and left side walls of the toner carry chamber 47 to be rotatable, respectively. At the right end of the second screw 25 on the outside of the right end of the toner carry chamber 47, the second screw drive gear 56 is provided so as not to be rotatable relatively. The second screw drive gear 56 engages with an unstiffening gear 68 from the front side.

At the left end of the second screw 25 in the inside of the left end part of the casing 43, a toner recovery blade 63 is provided. The toner recovery blade 63 is formed to be a plate-like member extending on one side in the radial direction of the second screw 25.

The toner supply chamber 23 is formed such that the upper half thereof has a rectangular shape when viewed as a side cross section. That is, the toner supply chamber 23 is a box-like member having a trapezoidal shape when viewed as a side cross section, and is formed such that a plane open area decreases gradually from the upper half part to the lower side. The lower end part of the toner supply chamber 23 is formed to have a curved shape so that the first screw 27 is accommodated. Further, the lower end part of the toner supply chamber 23 is formed to be a semispherical shape which is symmetrical with the toner carry chamber 47 with respect to the carry chamber side supply opening 57 and the carry chamber side recovery opening 58.

At the lower end of the rear part of the toner supply chamber 23, the supply chamber side supply opening 59 and the supply chamber side recovery opening 60 are formed. The supply chamber side supply opening 59 is formed at the right end of the toner supply chamber 23 to penetrate the right end part of the toner supply chamber 23 to face the carry chamber side supply opening 57. The supply chamber side recovery opening 60 is formed at the left end of the toner supply chamber 23 to penetrate the left end part of the toner supply chamber 23 to face the carry chamber side recovery opening 58.

At the lower end of the toner supply chamber 23, the first screw 27 is provided to extend in the left and right direction. The right and left ends of the first screw 27 are provided to penetrate the right and left side walls of the toner supply chamber 23 so that the first screw 27 is supported by the right and left side walls of the toner supply chamber 23 to be rotatable.

The first screw 27 is aligned with the second screw 25 in the front and rear direction to be parallel with the second screw 25. At the right end of the first screw 27 on the outside of the right end of the toner supply chamber 23, the first screw drive gear 61 is provided so as not to be rotatable relatively. The first screw drive gear 61 engages with the second screw drive gear 56 from the front side.

At the right end of the first screw 27 on the rightward inside of the toner supply chamber 23, the supply blade 62 is provided to face the supply chamber side supply opening 59. The toner supply blade 62 is formed to have a plate-like shape extending on one side in a radial direction of the first screw 27. The toner supply chamber 23 is formed to be connected to the toner carry chamber 47 such that the supply chamber side supply opening 59 faces the carry chamber side supply opening 57, and the supply chamber side recovery opening 60 faces the carry chamber side recovery opening 58. Thus, the toner carry chamber 47 is located between the toner supply chamber 23 and the toner reservoir 22.

Hereafter, operations of the process unit 15B are explained in detail.

When a driving force is transmitted from a motor (not shown) provided in the body casing 2 to the first screw drive gear 61, the first screw drive gear 61 rotates and the first screw 27 rotates. At the same time, the driving force is transmitted to the second screw drive gear 56 engaging with the first screw drive gear 61 and the driving gear 68 engaging with the second screw drive gear 56, and the second screw drive gear 56 and the driving gear 68 rotate. As a result, the second screw 25 and the unstiffening member 54 rotate.

In this case, the toner accommodated in the toner supply chamber 23 is carried from the leftward supply chamber side recovery opening 60 to the rightward supply chamber side supply opening 59 by rotation of the first screw 27, and at the right end part of the toner supply chamber 23, the toner is carried from the front side to the rear side by rotation of the toner supply blade 62. As a result, the toner passes through the supply chamber side supply opening 59 and the carry chamber side supply opening 57 from the front side to the rear side, and is supplied from the toner supply chamber 23 to the toner carry chamber 47.

Then, the toner which has been supplied to the toner carry chamber 47 is carried from the rightward carry chamber side supply opening 57 to the leftward carry chamber side recovery opening 58 by rotation of the second screw 25. Thereafter, at the left end part of the toner carry chamber 47, the toner is carried from the rear side to the front side by rotation of the toner recovery blade 63. As a result, the toner passes through the carry chamber side recovery opening 58 and the supply chamber side recovery opening 60 from the rear side to the front side, and is recovered to the toner supply chamber 23.

Then, the toner which has been recovered into the toner supply chamber 23 is carried again from the leftward supply chamber side recovery opening 60 to the rightward supply chamber side supply opening 59 by rotation of the first screw 27. As described above, the toner accommodated in the toner supply chamber 23 is circulated between the toner supply chamber 23 and the toner carry chamber 47.

At a midway point along the circulating path of the toner (i.e., when the toner is carried from the right side to the left side in the toner carry chamber 47), the toner is supplied to the toner reservoir 22 through the opening 48 due to the fact that the toner level in the toner carry chamber 47 is at the position higher than the opening 48.

By thus circulating the toner repeatedly, the toner is supplied to the toner reservoir 22 little by little.

The toner which has been supplied to the toner reservoir 22 is stored in the toner reservoir 22 while being unstiffened by the unstiffening member 54. With this configuration, the top level (i.e., hereafter, frequently referred to as a toner level) is kept at the position slightly higher than the upper edge of the opening 48 to face the rear wall 51 in the front and rear direction as indicated by the line L in FIG. 10.

In the state where the toner level L has become stable, the toner is carried from the lower side to the upper side at a midway point of the carry path along which the toner is carried from the carry chamber side supply opening 57 to the carry chamber side recovery opening 58.

Hereafter, carrying of the toner by the sending carrying substrate 26 is explained.

In order to stably carry the toner by the sending carrying substrate 26, a voltage is applied to lower carrying electrode 64. As a result, an electric field is generated around the lower carrying electrode 64, and the toner is collected around the lower carrying electrode 64.

Next, a voltage is applied to upper carrying electrode 64, and at the same time the voltage applied to the lower carrying electrode 64 is released. As a result, the electric field generated around the lower carrying electrode 64 disappears, and at the same time an electric field is generated around the upper carrying electrode 64. Accordingly, the toner which has been collected around the lower carrying electrode 64 is attracted by the electric field generated around the upper carrying electrode 64, and moves to the upper carrying electrode 64.

As described above, by continuously switching application of the voltage and releasing of the voltage application with respect to the carrying electrodes 64 of the sending carrying substrate 26, the toner is carried from the lower side to the upper side by the electric field which appears or disappears depending on the voltage application to each of the carrying electrodes 64 of the sending carrying substrate 26.

On the other hand, the toner not properly charged falls off the sending carrying substrate 26 by its own weight into the toner reservoir 22. The toner which has been carried to the upper end of the sending carrying substrate 26 jumps from the sending carrying substrate 26 to the development roller 24 by an electrostatic force pointing from the sending carrying substrate 26 to the development roller 24, and is held on the circumferential surface of the development roller 24.

Thereafter, the toner jumps from the development roller 24 to the photosensitive drum 18 through the electrostatic force pointing from the development roller 24 to the photosensitive drum 18. Thus, the toner is supplied to the electrostatic latent image on the circumferential surface of the photosensitive drum 18.

The application of the voltage and releasing the voltage application with respect to the returning carrying substrate 46 are controlled such that the returning carrying substrate 46 carries the toner in a direction opposite to the carrying direction of the sending carrying substrate 26. That is, the toner is carried form the upper side to the lower side by the returning carrying substrate 46. Then, when the toner which has not been supplied from the development roller 24 to the development roller 18 faces the returning carrying substrate 46 by rotation of the development roller 24, the toner receives the electrostatic force pointing from the development roller 24 to the returning carrying substrate 46. In this case, the toner jumps from the development roller 24 to the returning carrying substrate 46. Then, the toner is carried from the upper side to the tower side by the returning carrying substrate 46, and is returned into the toner reservoir 22.

Hereafter, advantages of the above described second embodiment are described.

(1) As shown in FIGS. 10 and 11, the first screw 27 carries the toner from the supply chamber side recovery opening 60 to the supply chamber side supply opening 59, and supplies the toner to the toner carry chamber 47 through the supply chamber side supply opening 59 and the carry chamber side supply opening 57. The second screw 25 carries the toner from the carry chamber side supply opening 57 to the carry chamber side recovery opening 58, and recovers the toner into the toner supply chamber 23 through the carry chamber side recovery opening 58 and the supply chamber side recovery opening 60.

Therefore, it becomes possible to circulate the toner between the toner supply chamber 23 and the toner carry chamber 47. Since the toner held in the toner carry chamber 47 is situated at the portion higher than the opening 48, the toner can be flowed into the toner reservoir 22 through the opening 48. Consequently, it becomes possible to supply the toner which is circulating from the carry chamber side supply opening 57 to the carry chamber side recovery opening 58 in the toner carry chamber 47, to the toner reservoir 22 through the opening 48.

(2) With this configuration, it becomes possible to supply the toner little by little from the toner carry chamber 47 to the toner reservoir 22 via the opening 48 while circulating the toner between the toner supply chamber 23 and the toner carry chamber 47. As a result, it becomes possible to keep the toner amount in the toner reservoir 22 constant, and thereby to keep the toner level L in the toner reservoir 22 constant.

In the toner reservoir 22, at a midway point along the carrying path of the toner from the carry chamber side supply opening 57 to the carry chamber side recovery opening 58, the sending carrying substrate 26 carries the toner from the lower side to the upper side. Therefore, the sending carrying substrate 26 is able to carry the toner in the toner reservoir 22 from the lower side to the upper side in a state where the toner level L is kept constant in the toner reservoir 22.

Consequently, it becomes possible to keep the carrying distance of the toner by the sending carrying substrate 26 constant, and thereby to securely shake off the toner not properly charged while the toner is being carried along the sending carrying substrate 26.

(2) In the toner supply unit 21, the opening 48 is formed to extend in the left and right direction in the toner carry chamber 47 so that the opening 48 faces the second screw 25. Therefore, it becomes possible to supply the toner from the toner carry chamber 47 to the toner reservoir 22 via the opening 48 throughout the left and right direction. As a result, it becomes possible to keep the toner level L constant in the toner reservoir 22 throughout the left and right direction.

(3) In the toner reservoir 22, the unstiffening member 54 which unstiffens the toner is provided. By unstiffening the toner in the toner reservoir 22 with the unstiffening member 54, it is possible to keep the toner level L constant in the toner reservoir 22 while securing fluidity of the toner.

(4) The sending carrying substrate 26 carries the toner in the up and down direction. Therefore, it is possible to securely shake off the toner not properly charged from the sending carrying substrate 26.

(5) The laser printer 1B includes the toner supply unit 21. Therefore, the laser printer 1B is able to from an image having an excellent quality.

(6) The laser printer 1B is configured to have the toner supply unit 21B for each of the photosensitive drums 18, to primarily transfer the toner image from each photosensitive drum 18 to the intermediate transfer belt 30, and to secondary transfer the toner image from the intermediate transfer belt 30 to the sheet of paper P. Such a configuration makes it possible to shake off the toner not properly charged along the carrying path of the toner, and thereby to achieve the image formation through use of intermediate transfer.

Figure 12:
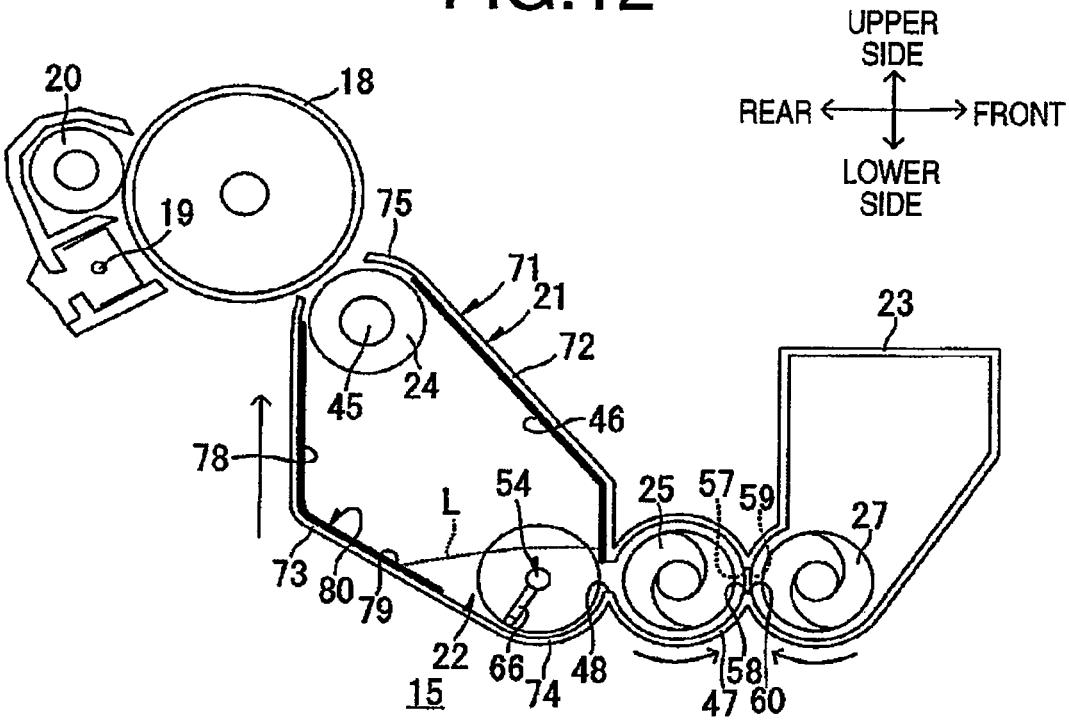
FIG. 12 is a side cross section of a process unit according to a first variation of the second embodiment.

Hereafter, a first variation of the toner supply unit according to the second embodiment is described with reference to FIG. 12. In FIG. 12, to elements which are substantially the same as those of the above described first embodiment, the same reference numbers are assigned and explanations thereof will not be repeated. In the following, the explanations focus on the feature of the first variation.

In the above described first embodiment, the development roller 24 is located on the upper side of the toner reservoir 22 to have a certain interval with respect to the toner reservoir 22, the casing 43 is formed to extend in the up and down direction and the left and right direction, and the casing 43 is formed to have a box-shape of which upper and lower end parts in the up and down direction are formed to be semi spherical shapes when viewed as a side view.

However, the shape of the casing 43 is not limited to the shape described in the second embodiment. Therefore, as shown in FIG. 12, the development roller 24 may be located to have a certain interval in a direction extending upward in a slanting direction toward the rear side with respect to the toner reservoir 22. The casing 71 may be formed to have a rhombic shape when viewed as a side view.

As shown in FIG. 12, the casing 71 includes a front wall 72, a rear wall 73, a bottom wall 74 and a top wall 75. The ends in the left and direction of the casing 71 are closed by a pair of side walls. The front wall 72 has a form of a letter "V" opened downward in a slanting direction, and is formed to be inclined downward toward the front side. The front end of the front wall 72 is bent downward.

The rear wall 73 has a form of a letter "V" opened upward in a slanting direction. More specifically, the rear wall 73 has an upper half part extending upward and straight in the up and down direction when viewed as a side view, and a lower half part extending downward and straight in a slanting direction toward the front side when viewed as a side view. The lower half part of the rear wall 73 faces the unstiffening member 54 in the front and rear direction.

The length of the upper half part of the rear wall 73 is, for example, 2 to 10 cm, and preferably is 3 to 7 cm. On the front surface (inner surface) of the rear wall 73, a sending carrying substrate 80 is integrally formed.

The sending carrying substrate 80 is a plate-like member having substantially the same length in the left and right direction as that of the development roller 24, and is formed to expand across the rear wall in the up and down direction.

More specifically, the sending carrying substrate 80 has a vertical part 78 provided on the upper half part of the rear wall 73 and a slanting part 79 formed on the lower half part of the rear wall 73.

The vertical part 78 extends in the up and down direction, and the upper end thereof faces the rear edge of the development roller 24 in the front and rear direction. The slanting part 79 is formed to be continuously connected to the lower end of the vertical part 78, and is formed to be inclined downward toward the front side. The lower end part of the slanting part 79 faces the unstiffening member 54 via a certain interval.

The length of the vertical part 78 of the sending carrying substrate 80 is, for example, 2 to 10 cm, and preferably is 3 to 7 cm. If the length of the vertical part 78 in the up and down direction is shorter than 2 cm, the toner not properly charged tends to be mixed into the toner properly charged and is supplied to the photosensitive drum, which is undesirable. On the other hand, if the length of the vertical part 78 is longer than 10 cm, a demerit that the size of the toner supply unit 21B becomes too large occurs although in this case a merit that the toner not properly charged can be securely removed is achieved.

The bottom wall 74 has a shape of a circular arc opened toward the upper side when viewed as a side view. The bottom wall 74 is formed such that the rear end of the bottom wall 74 is continuously connected to the lower end of the rear wall 73, and the front end of the bottom wall 74 is continuously connected to the lower end of the front wall 72.

The top wall 75 has a shape of a circular arc opened toward the lower side when viewed as a side view. The top wall 75 is formed such that the rear end of the top wall 75 is continuously connected to the upper end of the rear wall 73, and the front end of the top wall 75 is continuously connected to the upper end of the front wall 72. The opening is formed in the rear half part of the top wall 75.

In the casing 71, the development roller 24 is provided to extend in the left and right direction in a portion surrounded by the upper end part of the front wall 72, the top wall 75, and the upper end part of the rear wall 73.

A portion surrounded by the lower end part of the front wall 72, the bottom wall 74 and the lower end part of the rear wall 73 is formed as the toner reservoir 22.

As described above, the toner is stored in the toner reservoir 22, and the top edge (i.e., the toner level) of the stored toner is kept stably at the position (indicted by the dashed line L) which is slightly higher than the upper edge of the opening 48 and where the toner level L faces the lower half of the rear wall 73 in the front and rear direction.

In the image formation operation, the toner in the toner reservoir 22 is carried upward in a slanting direction toward the rear side along the slanting part 79, and then is carried upward by the vertical part 78 so that the toner is supplied to the development roller 24.

In this case, the toner not properly charged being carried upward in the up and down direction by the vertical part 78 is shook off from the vertical part 78 by its own weight.

It is understood that, according to the first variation, the same advantages as those achieved by the above described first embodiment can be achieved.

Figure 13:
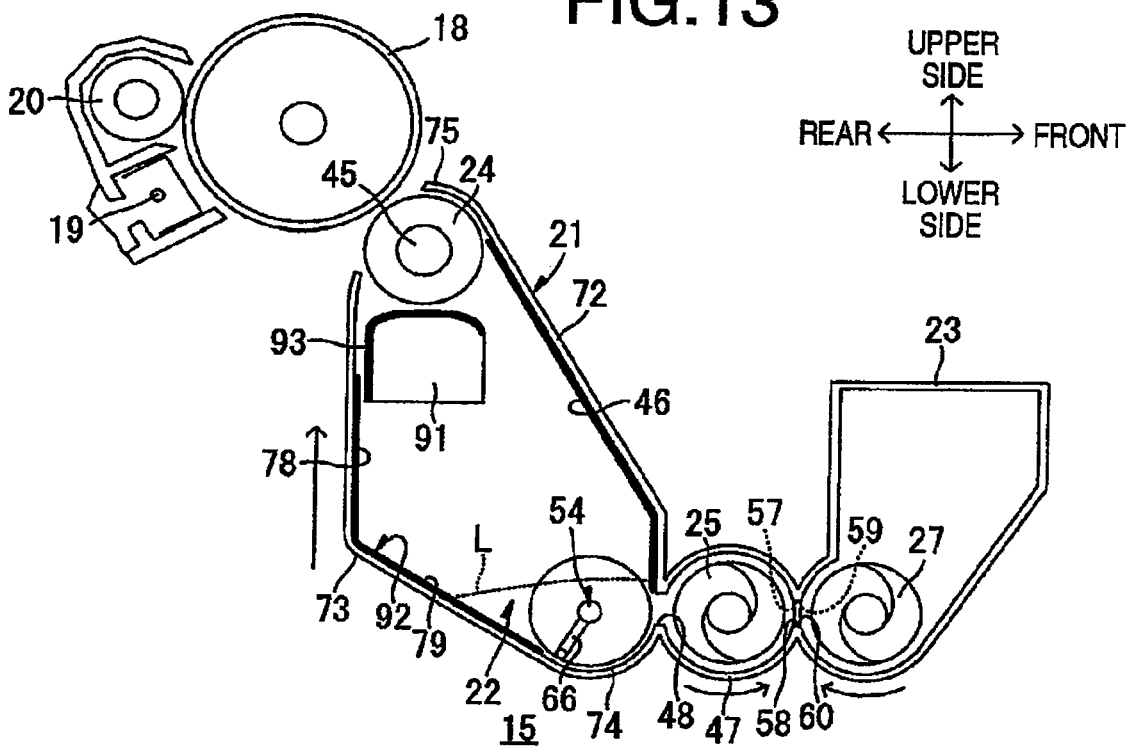
FIG. 13 is a side cross section of a process unit according to a second variation of the second embodiment.

Hereafter, a second variation of the toner supply unit according to the second embodiment is described with reference to FIG. 13. In FIG. 13, to elements which are substantially the same as those of the above described first embodiment, the same reference numbers are assigned and explanations thereof will not be repeated. In the following, the explanations focus on the feature of the second variation.

In the above described second embodiment, the sending carrying substrate 80 is formed throughout the length of the rear wall 73 in the up and down direction. However, the sending carrying substrate 80 may not be formed throughout the length of the rear wall 73 in the up and down direction, and the sending carrying substrate 80 may not have an integrated structure. That is, as shown in FIG. 6, a first sending carrying substrate 92 having an integrated structure may be provided such that the upper end of the first sending carrying substrate 92 is located at a substantially central portion of the rear wall 73 in the up and down direction so as not to face the development roller 24. In the casing 71, an intermediate carrying unit 91 may be located under the development roller 24 to face the lower edge of the development roller 24 in the up and down direction and to face the upper end part of the intermediate carrying unit 91 in the front and rear direction.

The intermediate carrying unit 91 is formed such that the upper end part thereof is curved to have a shape of a letter "U", and wholly has a rectangular shape. Further, the intermediate carrying unit 91 has a second sending carrying substrate 93.

The second sending carrying substrate 93 is formed to cover the entire upper surface and the rear surface of the intermediate carrying unit 91. More specifically, the second sending carrying substrate 93 extends upward from the lower end to the upper end of the intermediate carrying unit 91, and then extends toward the front side to reach the front end of the upper surface of the intermediate carrying unit 91. A part of the second sending carrying substrate 93 covering the upper surface of the intermediate carrying unit 91 faces the development roller 24 in the un and down direction.

The first sending carrying substrate 92 has the vertical part 78 provided on the upper half part of the rear wall 73, and the slanting part 79 provided on the lower half part of the rear wall 73.

The vertical part 78 extends in the up and down direction, and the upper end thereof faces the lower end of the second sending carrying substrate 93 at the central portion of the rear wall 73 in the up and down direction to have a certain interval with respect to the lower end of the second sending carrying substrate 93. The slanting part 79 is formed to be continuously connected to the lower end of the vertical part 78, and is formed to be inclined downward toward the front side. The lower end of the slanting part 79 faces the unstiffening member 54 via a certain interval.

In the image formation operation, at a midway point of the carrying path along which the toner proceeds from the reservoir side supply opening 76 to the reservoir side recovery opening 77, the toner is carried upward in a slanting direction along the slanting part 79, and then is carried upward along the vertical part 78. Then, at the upper end of the vertical part 78, the toner jumps from the vertical part 78 to the second sending carrying substrate 93 through a electrostatic force pointing from the vertical part 78 to the second sending carrying substrate 93.

Then, the toner us carried upward by the second sending carrying substrate 93, and is carried toward the front side. Then, at a midway point of the carrying path along which the toner is carried toward the front side, the toner faces the lower surface of the development roller 24, and jumps from the second sending carrying substrate 93 to the development roller 24. Thus, the toner is supplied to the development roller 24.

According to the second variation, even if the vertical part 78 of the second variation is formed to be shorter than the vertical part 78 of the first variation, the toner not properly charged can be shook off when the toner jumps from the vertical part 78 to the second sending carrying substrate 93 or when the toner is carried upward along the second sending carrying substrate 93.

It is understood that, according to the second variation, the same advantages as those achieved by the above described first embodiment can be achieved.

Figure 14:
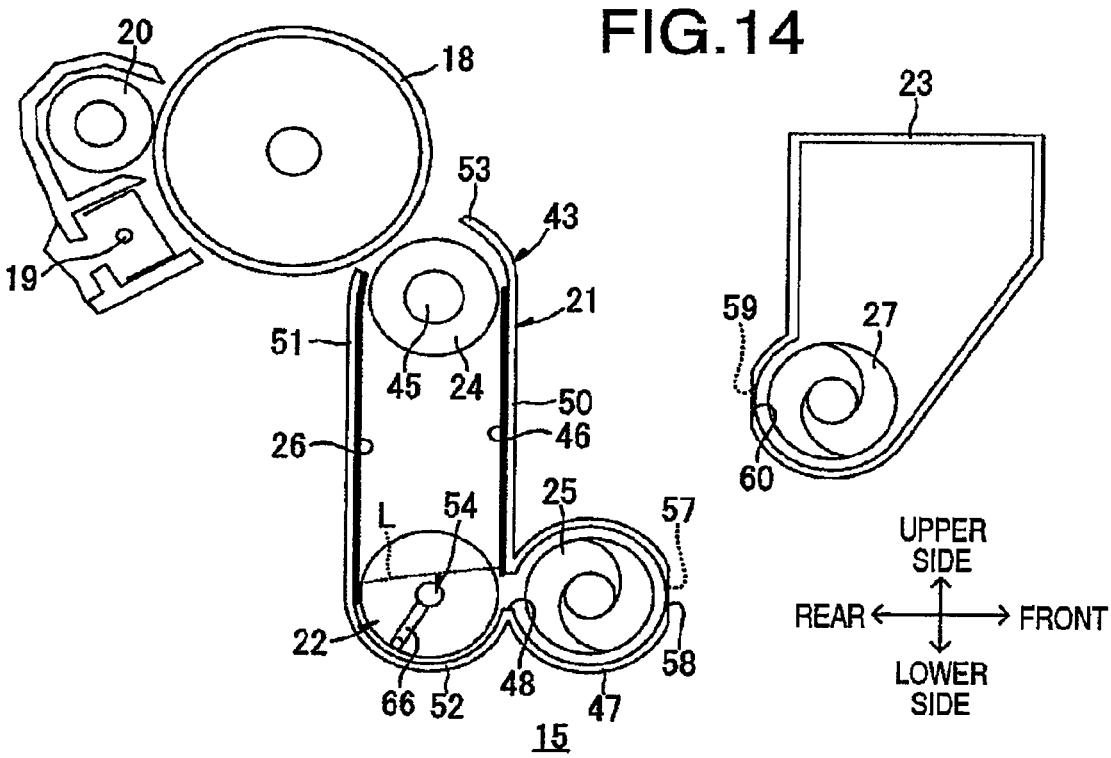
FIG. 14 is a side cross section of a process unit according to a third variation of the second embodiment.

Hereafter, a third variation of the toner supply unit according to the second embodiment is described with reference to FIG. 14. In FIG. 14, to elements which are substantially the same as those of the above described first embodiment, the same reference numbers are assigned and explanations thereof will not be repeated. In the following, the explanations focus on the feature of the third variation.

In the above described first embodiment, the toner supply chamber 23 is fixed to the toner carry chamber 47. However, the toner supply chamber 23 may be formed to be detachably attachable to the toner carry chamber 47 as shown in FIG. 14.

In the toner supply chamber 47 and the toner supply chamber 23, a shutter member may be may be provided to cover each of the supply openings (i.e., the carry chamber side supply opening 57 and the supply chamber side supply opening 59) and the recovery openings (i.e., the carry chamber side recovery opening and the supply chamber side recover opening 60) when the toner supply chamber 23 is detached from the toner carry chamber 47.

According to the third variation, it is possible to achieve the same advantages as those achieved by the first embodiment.

Figure 15:
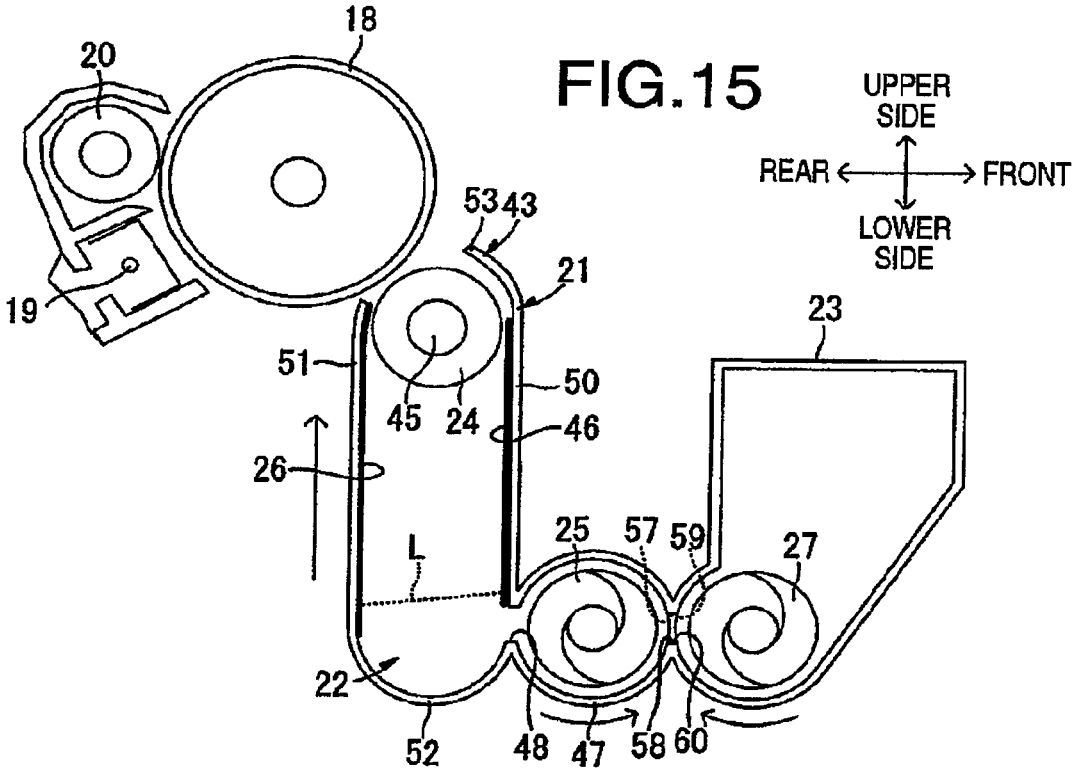
FIG. 15 is a side cross section of a process unit according to a fourth variation of the second embodiment.

Hereafter, a fourth variation of the toner supply unit according to the second embodiment is described with reference to FIG. 15. In FIG. 15, to elements which are substantially the same as those of the above described first embodiment, the same reference numbers are assigned and explanations thereof will not be repeated. In the following, the explanations focus on the feature of the third variation.

In the above described second embodiment, the unstiffening member 54 is provided in the toner reservoir 22. However, as shown in FIG. 15, the toner reservoir 22 may be configured not to have the unstiffening member 54. In this case, the toner flowed from the opening 48 is directory stored in the toner reservoir 22.

In the forth variation, the toner flowed from the opening 48 is stored in the toner reservoir 22 to form the horizontal top level (i.e., the toner level L) by its own weight. In this case, the toner level L is kept at the same height as that of the upper edge of the opening 48.

According to the fourth variation, it is possible to achieve the same advantages as those achieved by the above described second embodiment.

Third Embodiment

Hereafter, a laser printer 1C according to a third embodiment is described. In the following, to elements which are substantially the same as those shown in the first embodiment, same reference numbers are assigned, and explanations thereof will not be repeated. In the following, the explanations focus on the feature of the third embodiment.

Figure 16:
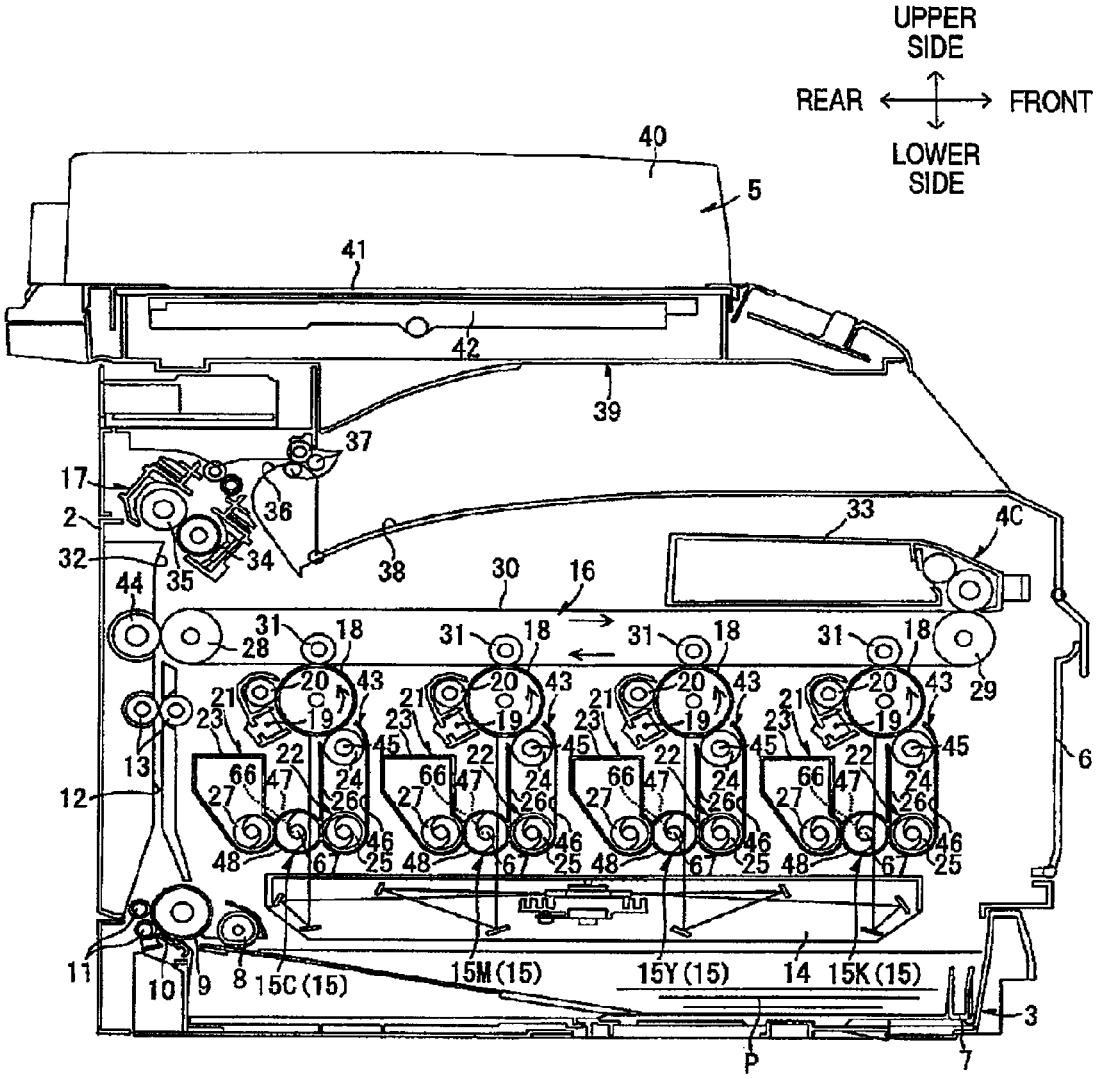
FIG. 16 is a side cross section of a laser printer according to a third embodiment.

As shown in FIG. 16, the laser printer 1C according to the third embodiment has substantially the same configuration as that of the first embodiment, and includes the body casing 2, the paper supply unit 3, an image formation unit 4C and the image reading unit 5.

The image formation unit 4C includes the scanning unit 14, four process units 15, the transfer unit 16 and the fixing unit 17.

Under the body casing 2, the scanning unit 14 is located on the upper side of the paper supply unit 3. The scanning unit 14 emits laser beams for the four photosensitive drums 18, respectively. That is, the scanning unit 14 emits each laser beam, to pass through space surrounded by a toner supply chamber 23, a casing 43, a first toner carry chamber 47, and a second toner carry chamber 48.

The process units 15 are provided respectively for four colors. More specifically, the process units 15 include a black process unit 15K, an yellow process unit 15Y, a magenta process unit 15M and a cyan process unit 15C, which are arranged in this order from the front side while securing certain intervals therebetween.

Each of the process units 15 includes the photosensitive drum 18 (i.e., an image holding body), the scorotron charger 19, the cleaning roller 20 and a toner supply unit 21 (i.e., a development device).

Hereafter, the toner supply unit 21 according to the third embodiment is explained in detail.

Each photosensitive drum 18 is provided to extend in the left and right direction. The four photosensitive drums 18 are arranged in the front and rear direction at certain intervals. Each photosensitive drum 18 is rotated in the counterclockwise direction when viewed from the left side (see FIG. 1).

The scorotoron charger 19 is provided under the rear part of the photosensitive drum 18 to face the photosensitive drum 18 at a certain interval.

The cleaning roller 20 is provided on the rear side of the photosensitive drum 18 to face the photosensitive drum 18.

Four toner supply units 21 are provided for the photosensitive drums 18, respectively. Each toner supply unit 21 includes a casing 43, a toner reservoir 22, the first toner carry chamber 47, the second toner carry chamber 48, and the toner supply chamber 23.

The casing 43 is provided under the front end of the photosensitive drum 18. The casing 43 has a box-shape extending in the up and down direction, and each of the ends of the casing 43 defined in the up and down direction is formed to be a semispherical shape. The rear half part of the upper portion of the casing 43 is provided with an opening extending in the left and right direction so that the opening faces the photosensitive drum 18.

In the casing 43, a development roller 24 (i.e., a developer holding body), a sending carrying substrate 26 and a returning carrying substrate 27 are accommodated.

The development roller 24 is a roller-like member having a cylindrical circumferential surface, and is provided to be rotatable about a rotation axis 45 extending in the left and right direction. The development roller 24 is provided above the toner reservoir 22 at the upper end portion of the casing so that the upper part there of is exposed to the outside through the opening of the casing 43. The development roller 24 faces the photosensitive drum 18 from the obliquely defined lower side through the opening of the casing 43.

The sending carrying substrate 26 is provided integrally with the inner surface of the rear wall 51 of the casing 43. The sending carrying substrate 26 is formed to be along the up and down direction such that the upper end of the sending carrying substrate 26 faces the development roller 24 to have a certain interval in the horizontal direction, and the lower end of the sending carrying substrate 26 is located between the first toner carry chamber 47 and the second toner carry chamber 48.

The returning carrying substrate 46 is provided integrally with the inter surface of the front wall 50 of the casing 43 in the up and down direction. As described in detail later, the returning carrying substrate 47 carries the toner from the upper side to the lower side through an electrostatic force to return the toner to the toner reservoir 22.

The toner reservoir 22 is provided at the bottom of the casing 43 to store a predetermined amount of toner. In the toner reservoir 22, the second screw 25 is provided.

The second screw 25 is provided to extend in the left and right direction in the toner reservoir 22. As described in detail later, the second screw 25 carries the toner from the right side to the left side.

The first toner carry chamber 47 is formed to have a cylindrical shape extending in the left and right direction, and is provided integrally with the casing 43 at the right end of the toner reservoir 22. Furthermore, the first toner carry chamber 47 is provided with a toner supply member 66 (third carry member). As described in detail later, a supply opening 68 is formed in the casing 43 to connect the first carry chamber 47 with the toner reservoir 22.

The toner supply member 66 is provided in the first toner carry chamber 47. As described in detail later, the toner supply member 66 has a second toner supply blade 101 and a support shaft 102 which rotatably supports the second toner supply blade 101. The toner supply member 66 is formed to carry the toner from the rear side to the front side.

The second toner carry chamber 48 is formed to have a cylindrical shape extending in the left and right direction, and is provided integrally with the casing 43 at the left end of the toner reservoir 22. Furthermore, the second toner carry chamber 48 is provided with a toner recovery member 67 (fourth carry member). As described in detail later, a recovery opening 69 is formed in the casing 43 to connect the second carry chamber 48 with the toner reservoir 22.

The toner recovery member 67 is provided in the second toner carry chamber 47. As described in detail later, the toner recovery member 67 has a second toner recovery blade 103 and a support shaft 104 which rotatably supports the second toner recovery blade 103. The toner recovery member 67 is formed to carry the toner from the front side to the rear side.

The toner supply chamber 23 is formed to have a box shape extending in the left and right direction. The toner supply chamber 23 is connected to the first toner carry chamber 47 and the second toner carry chamber 48 from the rear side of the first toner carry chamber 47 and the second toner carry chamber 48.

As described in detail later, at joint points between the toner supply chamber 23 and the first toner carry chamber 47 and the second toner carry chamber 48, a supply chamber side opening 57 and a recovery side opening 58 are provided, respectively. The toner supply chamber 23 and the first toner carry chamber 47 or the second toner carry chamber 48 are connected to communicate with each other through the supply side hole 57 and the recovery side opening 58.

In the toner supply chamber 23, the first screw 27 is provided. The first screw 27 is provided to extend in the left and right direction at the lower end of the toner supply chamber 23. As described in detail below, the first screw 27 carries the toner from the left side to the right side.

Hereafter, operations of the process unit 15 according to the third embodiment are explained in detail.

The toner accommodated in the toner supply chamber 23 is carried from the left side to the right side in the toner supply chamber 23 by rotation of the first screw 2, and is supplied to the first toner carry chamber 47 via the supply opening 68 via the supply side opening 57. The toner which has supplied to the first toner carry chamber 47 is carried from the rear side to the front side in the first toner carry chamber 47 via the supply opening 68 by the toner supply member 66, and is supplied to the toner reservoir 22 via the supply hole 68.

The toner contacts the sending carrying substrate 26 at a midway point of the carrying path of the toner being carried from the right side to the left side in the toner reservoir 22. The toner which has contacted the sending carrying substrate 26 receives an electrostatic force pointing from the lower side to the upper side from the sending carrying substrate 26, and is carried from the lower side to the upper side. Then, the toner faces the development roller 24 at the upper end of the sending carrying substrate 26.

The toner facing the development roller 24 receives an electrostatic force pointing from the sending carrying substrate 26 to the development roller 24, and jumps from the sending carrying substrate 26 to the development roller 24 to be held on the circumferential surface of the development roller 24.

The outer circumferential surface of the photosensitive drum 18 is charged uniformly and positively by the scorotoron charger 19. Then, the positively charged outer circumferential surface of the development roller 18 is scanned by the laser beam from the scanning unit 14 while the development roller 18 rotates. As a result, an electrostatic latent image (i.e., an image to be formed on the sheet of paper P) is formed on the outer circumferential surface of the photosensitive drum 18.

While the photosensitive drum 18 is rotated, the toner held on the development roller 24 reaches the position facing the electrostatic latent image on the photosensitive drum 18.

At this time, the toner held on the development roller 4 receives the electrostatic force pointing from the development roller 24 to the electrostatic latent image, and jumps toward the electrostatic latent image. Thus, the toner is supplied to the electrostatic latent image formed on the outer circumferential surface of the photosensitive drum 18.

The toner facing parts of the outer circumferential surface of the photosensitive drum 18 where the electrostatic latent image is not formed receives an electrostatic force pointing from the photosensitive drum 18 to the development roller 24, and therefore is not supplied to the photosensitive drum 18 and remains on the outer surface of the development roller 24. The toner remaining on the outer surface of the development roller 24 is carried by the returning carrying substrate 46 to the toner reservoir 22.

Thus, the electrostatic latent image is developed, and a toner image is held on the outer circumferential surface of the photosensitive drum 18.

Hereafter, the configuration of the process unit 15 according to the third embodiment is explained in detail.

Figure 17:
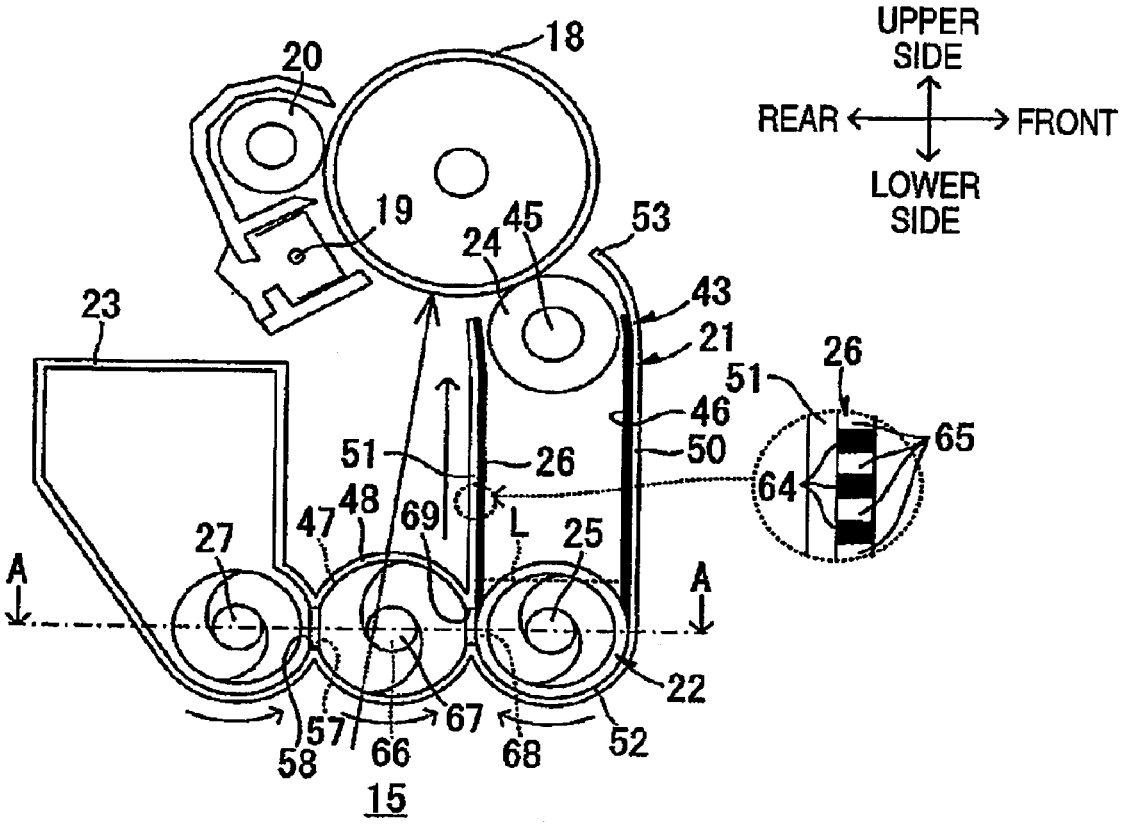
FIG. 17 is a side cross section of a process unit shown in FIG. 16.
Figure 18:
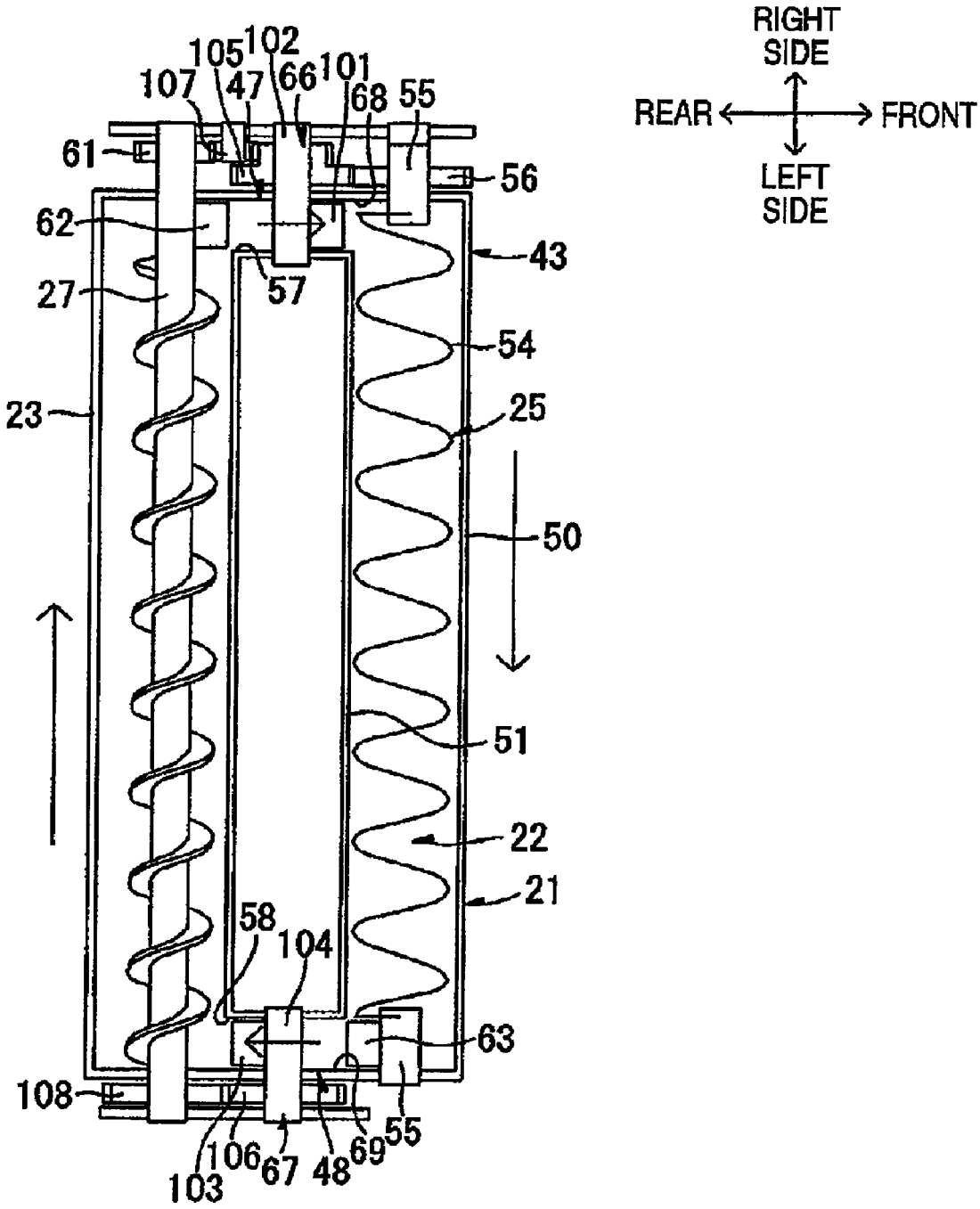
FIG. 18 is a cross sectional view of the process unit along a line A-A in FIG. 17.

As shown in FIGS. 17 and 18, the toner supply unit 21 includes the casing 43, the toner reservoir 22, the first toner carry chamber 47, the second toner carry chamber 48 and the toner supply chamber 23.

The casing 43 has a front wall 50, a rear wall 51, a bottom wall 52 and a top wall 53. The ends of the casing 43 in the left and right direction are closed by a pair of side walls. Each of the front wall 50 and the rear wall 51 is elongated in the up and down direction, and is formed to be a plate-like member when viewed as a side cross section. The front wall 50 and the rear wall 51 are located to face with each other via a certain interval. The length of each of the front wall 50 and the rear wall 51 in the up and down direction is, for example, 2 to 10 cm, and preferably is 3 to 7 cm.

At the lower end part in the rear wall 51, the supply opening 68 and the recovery opening 69 are formed. On the inner front surface of the rear wall 51, the sending carrying substrate 26 is integrally provided. On the rear surface of the front wall 59, the returning carrying substrate 46 is integrally formed.

The supply opening 68 is formed to penetrate the right end part of the rear wall 51 so that the toner reservoir 22 and the first toner carry chamber 47 communicate with each other. The recovery opening 69 is arranged to have a certain interval with the supply opening in the left and right direction, and is formed to penetrate the left end part of the rear wall 51 in the front and rear direction so that the toner reservoir 22 communicates with the second toner carry chamber 48.

The sending carrying substrate 26 is a plate-like member having the same length in the left and right direction as the length of the development roller 24 in the left and right direction, and is formed to have the size in the up and down direction substantially the same as that of the rear wall 51. That is, the sending carrying substrate 26 has a vertical carrying part extending in the up and down direction.

The length of the sending carrying substrate 26 in the up and down direction is, for example, 2 cm, and preferably is 3 to 7 cm. If the length of the sending carrying substrate 26 is shorter than 2 cm, the toner not properly charged tends to be mixed into the toner properly charged, which is undesirable. On the other hand, if the length of the sending carrying substrate 26 is longer than 10 cm, a demerit that the size of the toner supply unit 21 becomes too large occurs although in this case a merit that the toner not properly charged can be securely removed is achieved.

The sending carrying substrate 26 includes a plurality of carrying electrodes 64 and a plurality of insulating parts 65. Each of the plurality of carrying electrodes 64 is formed to be a linear pattern extending in the left and right direction, and the plurality of carrying electrodes are arranged in the up and down direction at certain intervals. The plurality of carrying electrodes 64 are connected to a power supply unit (not shown) which supplies a voltage at predetermined timing to the plurality of electrodes 64.

Each of the insulating parts 65 is provided between adjacent ones of the plurality of carrying electrodes 64 so as to provide electrical isolation between adjacent ones of the plurality of carrying electrodes 64.

Similarly to the sending carrying substrate 26, the returning carrying substrate 46 is formed as a electric field carrying substrate. The returning carrying substrate 46 is formed to be a plate-like member having the length in the left and right direction substantially equal to the length of the development roller 24 in the left and right direction. The size of the returning carrying substrate 46 in the up and down direction is substantially equal to the size of the front wall 50 in the up and down direction. The upper end of the returning carrying substrate 46 is located to face the front end of the development roller 24 via a certain interval in the horizontal direction, and the lower end of the returning carrying substrate 46 is located to face the front end of the second screw 25 via a certain interval in the horizontal direction. In this configuration, the returning carrying substrate 46 carries the toner from the upper side to the lower side through an electrostatic force.

The bottom wall 52 is formed to have a semispherical shape when viewed as a side cross section so that the upper side thereof is opened. The rear end of the bottom wall 52 connects with the lower end of the rear wall 51, and the front end of the bottom wall 52 connects with the lower end of the front wall 50.

The top wall 53 is formed to have a semispherical shape when viewed as a side cross section so that the lower side thereof is opened. The rear end of the top wall 53 connects with the upper end of the rear wall 51, and the front end of the top wall 52 connects with the upper end of the front wall 50. Further, in the rear half part of the top wall 52, the opening is formed to be opened toward the photosensitive drum 18.

The toner reservoir 22 is formed as space surrounded by the lower end part of the front wall 50, the bottom wall 52, and the lower end of the rear wall 51. In the toner reservoir 22, the second screw 25 is provided to extend in the left and right direction. The second screw 25 is located to face the lower end parts of the front wall 50 and the rear wall 51 in the front and rear direction. The second screw 25 is arranged to be parallel with the development roller 24 to have a certain interval in the up and down direction. The second screw 25 has a spiral part 54 and a pair of support parts 55.

Figure 19:
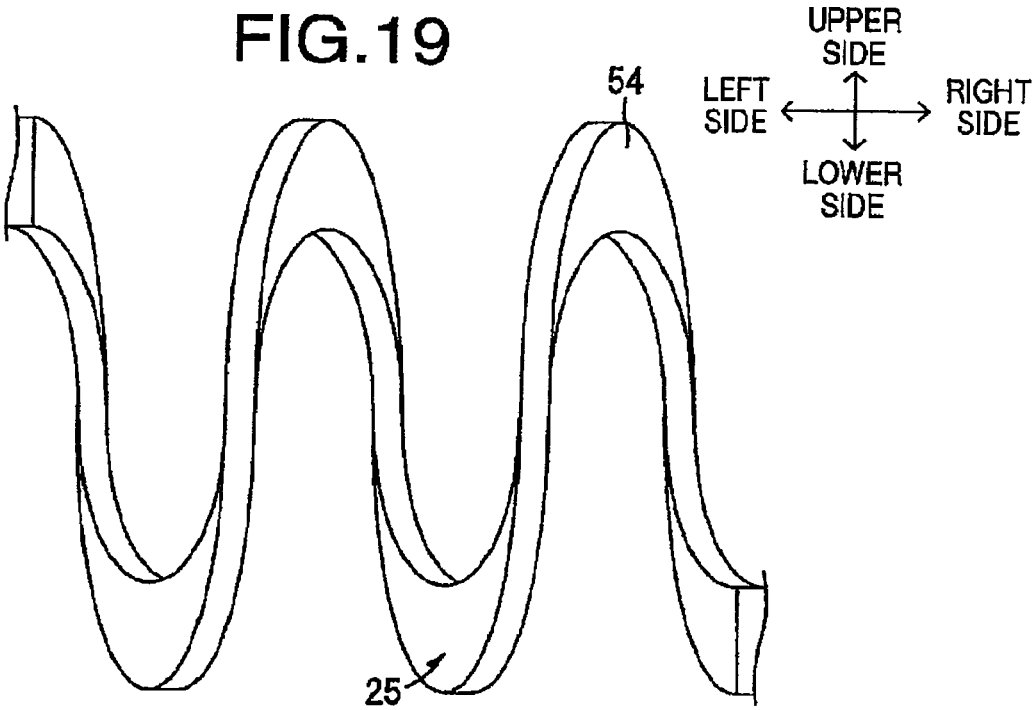
FIG. 19 is a front view of a spiral part of a second screw shown in FIG. 18.

As shown in FIG. 19, the spiral part 54 has a form of a coil spring. That is, the spiral part 54 has a ring shape when viewed as a side view, and is formed to have a spiral shape extending in the left and right direction. The support parts 55 are provided to be continuously connected to the both ends of the spiral part 54. More specifically, the support parts 55 have cylindrical shapes extending outward in the left and right direction from the both ends of the spiral part 54 in the left and right direction, respectively, such that each support part 55 is coaxial with respect to the center axis of the spiral part 54. Furthermore, the support parts 55 are provided to penetrate the left and right side walls of the casing 43, respectively, and are rotatably supported by the side walls of the casing 43.

On the outside of the right end of the casing 43, a second screw gear 56 is formed on the right support part 55 so as not to be rotatable relatively. On the outside of the left end of the casing 43, a first toner recovery blade 63 is formed on the left support part 55 to face the recovery opening 69. The first toner recovery blade 63 is formed to have a plate-like member extending on one side in a radial direction of the support part 55.

The first toner carry chamber 47 is formed to have a cylindrical shape extending in the left and right direction, and is provided on the rear side of the right end of the toner reservoir 22. The first toner carry chamber 47 is formed integrally with the rear wall 51 of the casing 51 to be continuously connected to the periphery of the supply opening 68. More specifically, the upper half of the first toner carry chamber 47 is formed such that the rear end thereof is continuously connected to the upper edge of the supply opening 68. Further, the lower half is formed such that the rear end thereof is continuously connected to the lower edge of the opening 68. Furthermore, the eight and left ends of the first toner carry chamber 47 are formed to be continuously connected to the right and left edges of the supply opening 68. In the first toner carry chamber 47, the toner supply member 66 is provided.

As described above, the toner supply member 66 has the support shaft 102 and the second toner supply blade 101. The second toner supply blade 101 is a plate-like member having the length in the left and right direction substantially equal to the length of the first toner carry chamber 47 in the left and right direction, and is formed to extend on one side in a radial direction of the support shaft 192 from the outer surface of the support shaft 102.

The support shaft 102 is formed to extend in the left and right direction, and right and left ends thereof are formed to penetrate right and left side walls of the first toner carry chamber 47, respectively, so that the support shaft 102 is supported by the right and left side walls of the first toner carry chamber 47.

At the eight end of the support shaft 102 on the outside of the right end of the first toner carry chamber 47, a drive gear 105 is provided so as not to be rotatable relatively. The drive gear 105 is formed such that a relatively large diameter gear and a relatively small diameter gear are integrally provided to overlap with each other. The relatively large diameter gear engages with the second screw drive gear 56 from the rear side.

The second carry chamber 48 is formed to have a cylindrical shape extending in the left and right direction, and is located on the rear side of the left end of the toner reservoir 22. The second toner carry chamber 48 is provided integrally with the rear wall 51 of the casing 43 so that the second toner carry chamber 48 is continuously connected with the periphery of the recovery opening 69. More specifically, the rear end of the upper half of the second toner carry chamber 48 is formed to be continuously connected with the upper edge of the recovery opening 69, and the rear end of the lower half of the second toner carry chamber 48 is formed to be continuously connected with the lower edge of the recovery opening 69. Further, the right and left ends of the second toner carry chamber 48 are formed to be continuously connected with the right and left edges of the recovery opening 69.

In the second toner carry chamber 48, the toner recover member 67 is provided. As described above, the toner recovery member 67 has a second toner recovery blade 103 and a support shaft 104.

The second toner recovery blade 103 is formed to extend on one side in a radial direction of the support shaft 104 from the outer surface of the support shaft 104, and is formed as a plate-like member having substantially the same length in the left and right direction as the length of the second toner carry chamber 48 in the left and right direction, The support shaft 104 extends in the left and right direction, and right and left ends thereof penetrate through the right and left side walls of the second toner carry chamber 48 so the support shaft 104 is supported rotatably by the right and left side walls of the second toner carry chamber 48. At the left end of the support shaft 104 on the outside of the left end of the second toner carry chamber 48, a drive gear 106 is provided so as not to be rotatable relatively.

The toner supply chamber 23 is formed such that the upper part thereof has a rectangular shape when viewed as a side view, and the area of the opening defined as a cross section viewed from the top side decreases gradually from the upper side to the lower side. That is, the toner supply chamber 23 is a box-like member having a trapezoidal shape when viewed as a side cross section. At the lower end of the front end part of the toner supply chamber 23, the supply chamber side opening 57 and the recovery side opening 58 are formed. Further, the lower end of the toner supply chamber 23 is formed to have a curved shape. That is, the lower end part of the toner supply chamber 23 is formed to have a semispherical shape which is symmetrical with the first toner carry chamber 47 and the second toner carry chamber 48 with respect to the supply chamber side opening 57 and the recovery side opening 58.

The supply chamber side opening 57 is formed to penetrate the right end part of the toner supply chamber 23 in the front and rear direction to face the supply opening 68. The recovery side opening 58 is formed to penetrate the left end part of the toner supply chamber 23 in the front and rear direction to face the recovery opening 69. At the lower end part of the toner supply chamber 23, the first screw 27 is provided to extend in the left and right direction.

The right and left ends of the first screw 27 are provided to penetrate the right and left side walls of the toner supply chamber 23 so that the first screw 27 is rotatably supported by the right and left side walls of the toner supply chamber 23. The first screw 27 is arranged to be parallel with the second screw 25 in the front and rear direction.

On the outside of the right end of the toner supply chamber 23, the first screw drive gear 61 is provided at the right end of the first screw 27 so as not to be rotatable relatively. The first screw drive gear 61 engages with the small diameter gear of the drive gear 105 from the rear side via an idle gear 107. On the outside of the left end of the toner supply chamber 23, a transmission gear 108 is provided at the left end of the first screw 27 so as not to be rotatable relatively. The transmission gear 108 engages with the drive gear 106 from the rear side.

Further, inside of the right end part of the toner supply chamber 23, the first toner supply blade 62 is formed to face the supply chamber side opening 57 at the right end of the first screw 27. The first toner supply blade 62 is formed to be a plate-like member extending on one side of the radial direction of the first screw 27. The toner supply chamber 23 is connected to the first toner supply chamber 47 and the second toner supply chamber 48 such that the supply chamber side opening 57 faces the rear end of the first toner carry chamber 47 and the recovery side opening 58 faces the rear end part of the second toner carry chamber 48.

With this configuration, the toner supply chamber 23, the casing 43, the first toner carry chamber 47, and the second toner carry chamber 48 form a rectangular shape when viewed as a plan view, and the laser beam passes the space surrounded by these components.

When a driving force is transmitted from a motor (not shown) to the second screw drive gear 56, the second screw drive gear 56 rotates, and the second screw 25 rotates. At the same time, the driving force is transmitted to the drive gear 105 which engages with the second screw drive gear 56, and the first screw drive gear 61 which engages with the drive gear 105 via the idle gear 107. Then, the drive gear 105 and the first screw drive gear 61 rotate, and the toner supply member 66 and the first screw 27 rotate. When the first screw 27 rotates, the transmission gear 108 provided at the left end of the first screw 27 rotates, and the driving force is transmitted to the drive gear 106 which engages with the transmission gear 108. In this case, the drive gear 106 rotates, and the toner recovery member 67 rotates.

Further, in this case, the toner stored in the toner supply chamber 23 is carried from the left side to the right side by rotation of the first screw 27, and at the right end of the toner supply chamber 23, the toner is carried from the rear side to the front side by the toner supply blade 62. As a result, the toner passes the supply chamber side opening 57 from the rear side to the front side, and is carried from the toner supply chamber 23 to the first toner carry chamber 47.

Then, the toner which has been supplied to the first toner carry chamber 47 is carried from the rear side to the front side by the second toner supply blade 101, and is supplied to the toner reservoir 22 by passing through the supply opening 68 from the rear side to the front side.

Then, the toner which has been supplied to the toner reservoir 22 is carried from the right side to the left side by rotation of the second screw 25, and thereafter is carried from the front side to the rear side by the first toner recover blade 63 at the left end part of the toner reservoir 22.

As a result, the toner passes through the recovery opening 69 from the front side to the rear side, and is supplied from the toner reservoir 22 to the second toner carry chamber 48. The toner which been supplied to the second toner carry chamber 48 is carried from the front side to the rear side by the second toner recovery blade 103, and is recovered into the toner supply chamber 23 while passing through the recovery side opening 58.

The toner which has been recovered into the toner supply chamber 23 is carried again from the left side to the right side by rotation of the first screw 27. As described above, the toner is supplied from the toner supply chamber 23 to the toner reservoir 22 by passing through the first toner carry chamber 47, and is recovered from the toner reservoir 22 to the toner supply chamber 23 by passing through the second toner carry chamber 48. Thus, the toner is circulated between the toner supply chamber 23 and the toner reservoir 22.

By repeatedly circulating the toner, the top of the toner (i.e., the toner level) stored in the toner reservoir 22 is kept constant at the position (i.e., the position L indicated by a dashed line in FIG. 17) which is lower than the upper end of the second screw 25 and where the top of the toner faces the rear wall 51 in the front and rear direction. While the toner level L is kept constant, the toner is carried from the lower side to the upper side along the sending carrying substrate 26 at a midway point of the carrying path along which the toner is carried from the supply opening 68 to the recovery opening 69.

Hereafter, carrying of the toner by the sending carrying substrate 26 is explained.

In order to stably carry the toner by the sending carrying substrate 26, a voltage is applied to lower carrying electrodes 64. As a result, an electric field is generated around the lower carrying electrodes 64, and the toner is collected around the lower carrying electrodes 64.

Next, a voltage is applied to upper carrying electrodes 64, and at the same time the voltage applied to the lower carrying electrodes 64 is released. As a result, the electric field generated around the lower carrying electrodes 64 disappears, and at the same time an electric field is generated around the upper carrying electrodes 64. Accordingly, the toner which has been collected around the lower carrying electrodes 64 is attracted by the electric field generated around the upper carrying electrodes 64, and moves to the upper carrying electrodes 64.

As described above, by continuously switching application of the voltage and releasing of the voltage application with respect to the carrying electrodes 64 of the sending carrying substrate 26, the toner is carried from the lower side to the upper side by the electric field which appears or disappears depending on the voltage application to each of the carrying electrodes 64 of the sending carrying substrate 26.

On the other hand, the toner not properly charged falls off the sending carrying substrate 26 by its own weight into the toner reservoir 22.

The toner which has been carried to the upper end of the sending carrying substrate 26 jumps from the sending carrying substrate 26 to the development roller 24 by an electrostatic force pointing from the sending carrying substrate 26 to the development roller 24, and is held on the circumferential surface of the development roller 24.

Thereafter, the toner jumps from the development roller 24 to the photosensitive drum 18 through the electrostatic force pointing from the development roller 24 to the photosensitive drum 18. Thus, the toner is supplied to the electrostatic latent image on the circumferential surface of the photosensitive drum 18.

The application of the voltage and releasing the voltage application with respect to the returning carrying substrate 46 are controlled such that the returning carrying substrate 46 carries the toner in a direction opposite to the carrying direction of the sending carrying substrate 26. That is, the toner is carried form the upper side to the lower side by the returning carrying substrate 46. Then, when the toner which has not been supplied from the development roller 24 to the development roller 18 faces the returning carrying substrate 46 by rotation of the development roller 24, the toner receives the electrostatic force pointing from the development roller 24 to the returning carrying substrate 46. In this case, the toner jumps from the development roller 24 to the returning carrying substrate 46. Then, the toner is carried from the upper side to the lower side by the returning carrying substrate 46, and is returned into the toner reservoir 22.

(1) As shown in FIGS. 17 and 18, the first screw 27 carries the toner from the left side to the right side in the toner supply chamber 23, and the toner supply member 66 carries the toner supplied from the first screw 27 to the toner reservoir 22 in the first toner carry chamber 47. Further, the second screw 25 carries the toner from the right side to the left side in the toner reservoir 22, and the toner recovery member 67 carries the toner to the toner supply chamber 23 in the second carry chamber 48.

Therefore, it is possible to carry the toner from the toner supply chamber 23 to the toner reservoir 22 via the first toner carry chamber 47, and to carry the toner from the toner reservoir 22 to the toner supply chamber 23 via the second toner carry chamber 48. Consequently, the toner can be circulated between the toner supply chamber 23 and the toner reservoir 22.

Furthermore, it is possible to supply the toner from the toner supply chamber 23 to the toner reservoir 22 via the first toner carry chamber 47 while keeping the toner amount constant in the toner reservoir 22. Furthermore, it is possible to recover the toner in the toner reservoir 22 into the toner supply chamber 23 via the second toner carry chamber 48 while keeping the toner amount constant in the toner reservoir 22.

As a result, it becomes possible to keep the toner amount constant in the toner reservoir 22, and thereby it becomes possible to keep the toner level L constant in the toner reservoir 22.

Furthermore, the sending carrying substrate 26 is able to carry the toner upward to the developer roller 24 at a midway point along the carrying path along which the toner proceeds from the first toner carry chamber 47 to the second toner carry chamber 48. Therefore, the sending carrying substrate 26 is able to carry the toner upward to the development roller 24 in the state where the toner level L is kept constant in the tone reservoir 22.

Consequently, it becomes possible to keep the carrying distance by which the toner is carried by the sending carrying substrate 26 constant, and to stably shake off the toner not properly charged from the sending carrying substrate 26.

(2) In the toner carry unit 21, the first screw 27 and the second screw 25 are arranged in parallel with each other in the front and rear direction, and the toner supply member 66 and the toner recover member 67 are arranged to extend in the left and right direction.

That is, the first screw 27, the second screw 25, the toner supply member 66 and the toner recovery member 67 are arranged on a common horizontal plane. Therefore, the toner can be circulated, in the common horizontal plane, between the toner supply chamber 23 and the toner reservoir 22. As a result, it becomes possible to keep the tuner level L constant more stably in the toner reservoir 22.

(3) In the toner supply unit 21, the sending carrying substrate 26 carries the toner in the vertical direction. Such a configuration makes it possible to securely shake off the toner not properly charged along the vertical parrying path.

(4) In the toner supply unit 21, the toner level L is at the position lower than the upper edge of the second screw 25. Therefore, it becomes possible to securely carry the toner by the second screw 25.

When viewed as a side view, the toner level L faces, in the front and rear direction, the front surface of the rear wall 51 of the casing 43 which is formed to be straight. Therefore, it becomes possible to keep the toner level L in the vicinity of the front surface of the rear wall 51 constant. In the toner supply unit 21, the second screw 25 has a circular shape when viewed as a side view, and has the spiral part 54 having a spiral shape extending in the left and right direction. That is, the spiral part 54 of the second screw 25 has a form of a coil spring extending in the left and right direction.

Therefore, by rotating the second screw 25 in the circumferential direction of the spiral part 54, the toner can be carried in the left and right direction while suppressing the fluctuation of the toner level L caused in the toner reservoir 22 by rotation of the second screw and while preventing occurrence of scattering of the toner in the circumferential direction.

As a result, it becomes possible to keep the toner level L constant more stably in the toner reservoir 22.

(6) In the toner supply unit 21, the supply opening 68 and the recovery opening 69 are arranged to have a certain interval in the left and right direction. Such a configuration makes it possible to carry the toner to the toner reservoir 22 and to recover the toner from the toner reservoir 22 in the horizontal plane. As a result, the toner level L can be kept constant more stably in the toner reservoir 22.

(7) The laser printer 1C includes the toner supply unit 21. Therefore, the laser printer 1C is able to from an image having an excellent quality while shaking off the toner not properly charged in the carrying path of the toner.

(8) The laser printer 1C is configured to have the toner supply unit 21 for each of the photosensitive drums 18, to primarily transfer the toner image from each photosensitive drum 18 to the intermediate transfer belt 30, and to secondary transfer the toner image from the intermediate transfer belt 30 to the sheet of paper P. Such a configuration makes it possible to shake off the toner not properly charged along the carrying path of the toner, and thereby to achieve the image formation through use of intermediate transfer.

Figure 20:
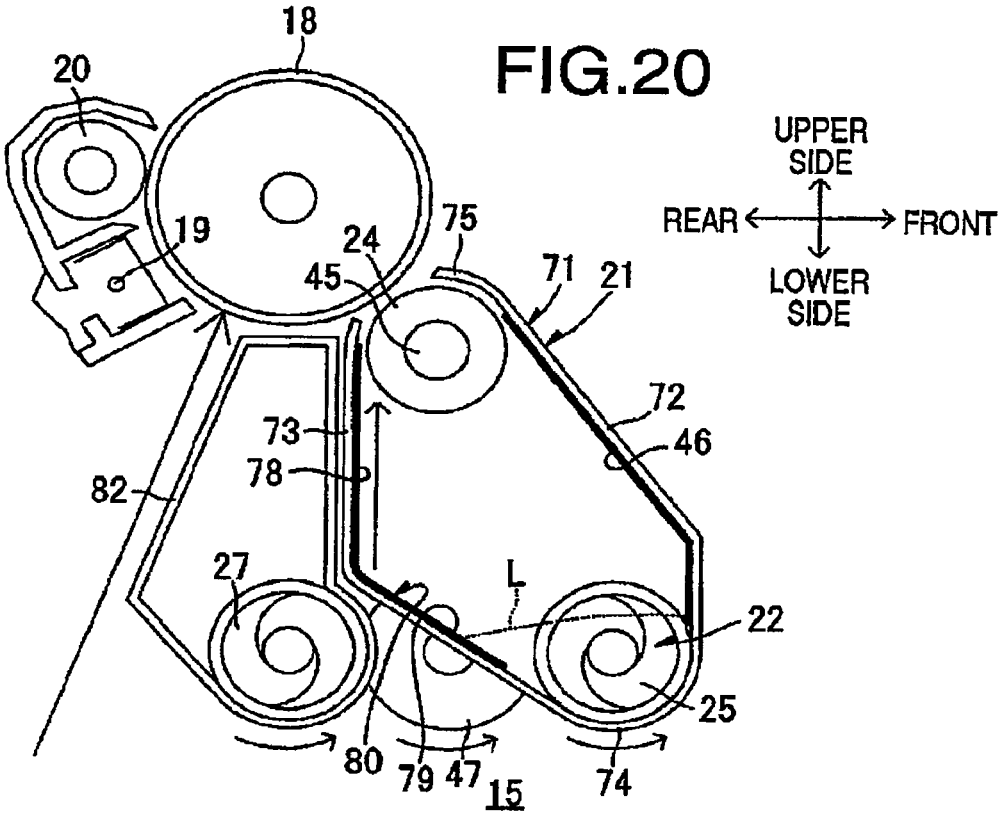
FIG. 20 is a side cross section of a process unit according to a first variation of the third embodiment.

Hereafter, a first variation of the toner supply unit according to the third embodiment is described with reference to FIG. 20. In FIG. 20, to elements which are substantially the same as those of the above described third embodiment, the same reference numbers are assigned and explanations thereof will not be repeated. In the following, the explanations focus on the feature of the first variation.

In the above described first embodiment, the development roller 24 is located on the upper side of the toner reservoir 22 to have a certain interval with respect to the toner reservoir 22, the casing 43 is formed to extend in the up and down direction and the left and right direction, and the casing 43 is formed to have a box-shape of which upper and lower end parts in the up and down direction are formed to be semispherical shapes when viewed as a side view. Further, the toner supply chamber 23 is formed such that the area of the plane opening gradually decreases from the upper side to the lower side.

However, the shape of the casing 43 is not limited to the shape described in the second embodiment. Therefore, as shown in FIG. 12, the development taller 24 may be located to have a certain interval in a direction extending upward in a slanting direction toward the rear side with respect to the toner reservoir 22. The casing 71 may be formed to have a rhombic shape when viewed as a side view. Furthermore, the toner supply chamber 82 may formed such that the area of the plane opening gradually increases from the upper side to the lower side.

As shown in FIG. 20, the casing 71 includes a front wall 72, a rear wall 73, a bottom wall 74 and a top wall 75. The ends in the left and direction of the casing 71 are closed by a pair of side walls. The front wall 72 has a form of a letter "V" opened downward in a slanting direction, and is formed to be inclined downward toward the front side. The front end of the front wall 72 is bent downward.

The rear wall 73 has a form of a letter "V" opened upward in a slanting direction. More specifically, the rear wall 73 has an upper half part extending upward and straight in the up and down direction when viewed as a side view, and a lower half part extending downward and straight in a slanting direction toward the front side when viewed as a side view. The lower half part of the rear wall 73 faces the unstiffening member 54 in the front and rear direction.

The length of the upper half part of the rear wall 73 is, for example, 2 to 10 cm, and preferably is 3 to 7 cm. On the front surface (inner surface) of the rear wall 73, a sending carrying substrate 80 is integrally formed.

The sending carrying substrate 80 is a plate-like member having substantially the same length in the left and right direction as that of the development roller 24, and is formed to expand across the rear wall in the up and down direction.

More specifically, the sending carrying substrate 80 has a vertical part 78 provided on the upper half part of the rear wall 73 and a slanting part 79 formed on the lower half part of the rear wall 73.

The vertical part 78 extends in the up and down direction, and the upper end thereof faces the rear edge of the development roller 24 in the front and rear direction. The slanting part 79 is formed to be continuously connected to the lower end of the vertical part 78, and is formed to be inclined downward toward the front side. The lower end part of the slanting part 79 is located between the first carry chamber 47 and the second carry chamber 38, and is located to face the second screw 25 in the front and rear direction.

The length of the vertical part 78 of the sending carrying substrate 80 is, for example, 2 to 10 cm, and preferably is 3 to 7 cm. If the length of the vertical part 78 in the up and down direction is shorter than 2 cm, the toner not properly charged tends to be mixed into the toner properly charged and is supplied to the photosensitive drum, which is undesirable. On the other hand, if the length of the vertical part 78 is longer than 10 cm, a demerit that the size of the toner supply unit 21B becomes too large occurs although in this case a merit that the toner not properly charged can be securely removed is achieved.

The bottom wall 74 has a shape of a circular arc opened toward the upper side when viewed as a side view. The bottom wall 74 is formed such that the rear end of the bottom wall 74 is continuously connected to the lower end of the rear wall 73, and the front end of the bottom wall 74 is continuously connected to the lower end of the front wall 72.

The top wall 75 has a shape of a circular arc opened toward the lower side when viewed as a side view. The top wall 75 is formed such that the rear end of the top wall 75 is continuously connected to the upper end of the rear wall 73, and the front end of the top wall 75 is continuously connected to the upper end of the front wall 72. The opening is formed in the rear half part of the top wall 75.

In the casing 71, the development roller 24 is provided to extend in the left and right direction in a portion surrounded by the upper end part of the front wall 72, the top wall 75, and the upper end part of the rear wall 73.

A portion surrounded by the lower end part of the front wall 72, the bottom wall 74 and the lower end part of the rear wall 73 is formed as the toner reservoir 22.

The upper part of the toner supply chamber 82 is formed to have a rectangular shape when viewed as a side cross section. Further, the toner supply chamber 82 is formed to have a trapezoidal box shape when viewed as a side cross section such that the area of the plane opening gradually increases from the upper side to the lower side.

The upper part of the toner supply chamber 82 is located to have a certain interval with respect to the scorotoron charger 19 so that the lower edge of the photosensitive drum 19 is exposed. As shown by a solid line in FIG. 20, the laser beam from the scanning unit 14 passes the position between the scorotoron charger 19 and the upper end part of the toner supply chamber 82, and is incident on the photosensitive drum 18.

The lower end part of the toner supply chamber 82 is formed to be a curved shape to accommodate the first screw 27. Further, the lower end part of the toner supply chamber 82 is formed to be a semispherical shape which is symmetrical with the first carry chamber 47 and the second carry chamber 48, with respect to the supply chamber side opening 57 and the recovery side opening 58.

As described above, by circulating the toner between the toner supply chamber 23 and the toner reservoir 22, the toner level of the toner stored in the toner reservoir 22 is kept at the position which is lower the upper edge of the second screw 25 and where the top of the toner faces the front surface of the lower half part of the rear wall 73.

In the image formation process, the toner is carried upward in a slanting direction along the slanting part 79 at a midway point in the carry path along which the toner is carried from the supply opening 68 to the recovery opening 69 in the toner reservoir 22. then, the toner is carried from the lower side to the upper side by the vertical part 78, and is supplied to the development roller 24.

In this case, the toner not properly charged is shook off the vertical part 78 by its own weight while being carried from the lower side to the upper side along the vertical part 78, and falls into the toner reservoir 22.

It is understood that, according to the first variation, the same advantages as those achieved by the above described first embodiment can be achieved.

Hereafter, a second variation of the toner supply unit according to the third embodiment is described with reference to FIG. 21. In FIG. 21, to elements which are substantially the same as those of the above described first embodiment, the same reference numbers are assigned and explanations thereof will not be repeated. In the following, the explanations focus on the feature of the second variation.

In the above described third embodiment, the sending carrying substrate 80 is formed throughout the length of the rear wall 73 in the up and down direction. However, the sending carrying substrate 80 may not be formed throughout the length of the rear wall 73 in the up and down direction, and the sending carrying substrate 80 may not have an integrated structure. That is, as shown in FIG. 6, a first sending carrying substrate 92 having an integrated structure may be provided such that the upper end of the first sending carrying substrate 92 is located at a substantially central portion of the rear wall 73 in the up and down direction so as not to face the development roller 24. In the casing 71, an intermediate carrying unit 91 may be located under the development roller 24 to face the lower edge of the development roller 24 in the up and down direction and to face the upper end part of the intermediate carrying unit 91 in the front and rear direction.

The intermediate carrying unit 91 is formed such that the upper end part thereof is curved to have a shape of a letter "U", and wholly has a rectangular shape. Further, the intermediate carrying unit 91 has a second sending carrying substrate 93.

The second sending carrying substrate 93 is formed to cover the entire upper surface and the rear surface of the intermediate carrying unit 91. More specifically, the second sending carrying substrate 93 extends upward from the lower end to the upper end of the intermediate carrying unit 91, and then extends toward the front side to reach the front end of the upper surface of the intermediate carrying unit 91. A part of the second sending carrying substrate 93 covering the upper surface of the intermediate carrying unit 91 faces the development roller 24 in the un and down direction.

The first sending carrying substrate 92 has the vertical part 78 provided on the upper half part of the rear wall 73, and the slanting part 79 provided on the lower half part of the rear wall 73.

The vertical part 78 extends in the up and down direction, and the upper end thereof faces the lower end of the second sending carrying substrate 93 at the central portion of the rear wall 73 in the up and down direction to have a certain interval with respect to the lower end of the second sending carrying substrate 93. The slanting part 79 is formed to be continuously connected to the lower end of the vertical part 78, and is formed to be inclined downward toward the front side. The lower end of the slanting part 79 is located between the first carry chamber 47 and the second carry chamber 48 to face the second screw 25.

In the image formation process, the toner is carried upward in a slanting direction along the slanting part 79 at a midway point of the carry path along which the toner is carried from the supply opening 68 to the recovery opening 69 in the toner reservoir 22. Then, the toner is carried upward in the vertical direction by the vertical part 78 to reach the upper end of the vertical part 78. At the upper end of the vertical part 78, the toner jumps from the vertical part 78 to the second sending carrying substrate 93 through an electrostatic force pointing from the vertical part 78 to the second sending carrying substrate 93.

Then, the toner which has been supplied to the second sending carrying substrate 83 is carried from the lower side to the upper side along the second sending carrying substrate 93, and the is carried toward the front side.

Then, the toner being carried to the front side along the second sending carrying substrate 93 faces the lower surface of the development roller 24, and jumps from the second sending carrying substrate 93 to the development roller 24. Thus, the toner is supplied to the development roller 24.

According to the second variation, even if the vertical part 78 of the second variation is formed to be shorter than the vertical part 78 of the first variation, the toner not properly charged can be shook off when the toner jumps from the vertical part 78 to the second sending carrying substrate 93 or when the toner is carried upward along the second sending carrying substrate 93.

It is understood that, according to the second variation, the same advantages as those achieved by the above described first embodiment can be achieved.

Hereafter, a third variation of the toner supply unit according to the third embodiment is described with reference to FIG. 22. In FIG. 22, to elements which are substantially the same as those of the above described third embodiment, the same reference numbers are assigned and explanations thereof will not be repeated. In the following, the explanations focus on the feature of the third variation.

In the above described third embodiment, the toner supply chamber 23 is provided so as not to be detachable from the first toner carry chamber 47 and the second toner carry chamber 48. However, as shown in FIG. 22, the toner supply chamber 23 may be attached to the first toner carry chamber 47 and the second toner carry chamber 48 so as to be detachable from the first toner carry chamber 47 and the second toner carry chamber 48.

In the toner supply chamber 23, shutter member may be provided to cover the supply chamber side opening 57 and the recovery side opening 58 in the state where the toner supply chamber 23 is detached.

According to the third variation, the same advantages as those achieved by the above described third embodiment can be achieved.

In the above described third embodiment, the second screw 25 is formed to have a shape of a coil spring. However, the second screw may have a shaft as shown in FIG. 23 (see a second screw 81).

Figure 23:
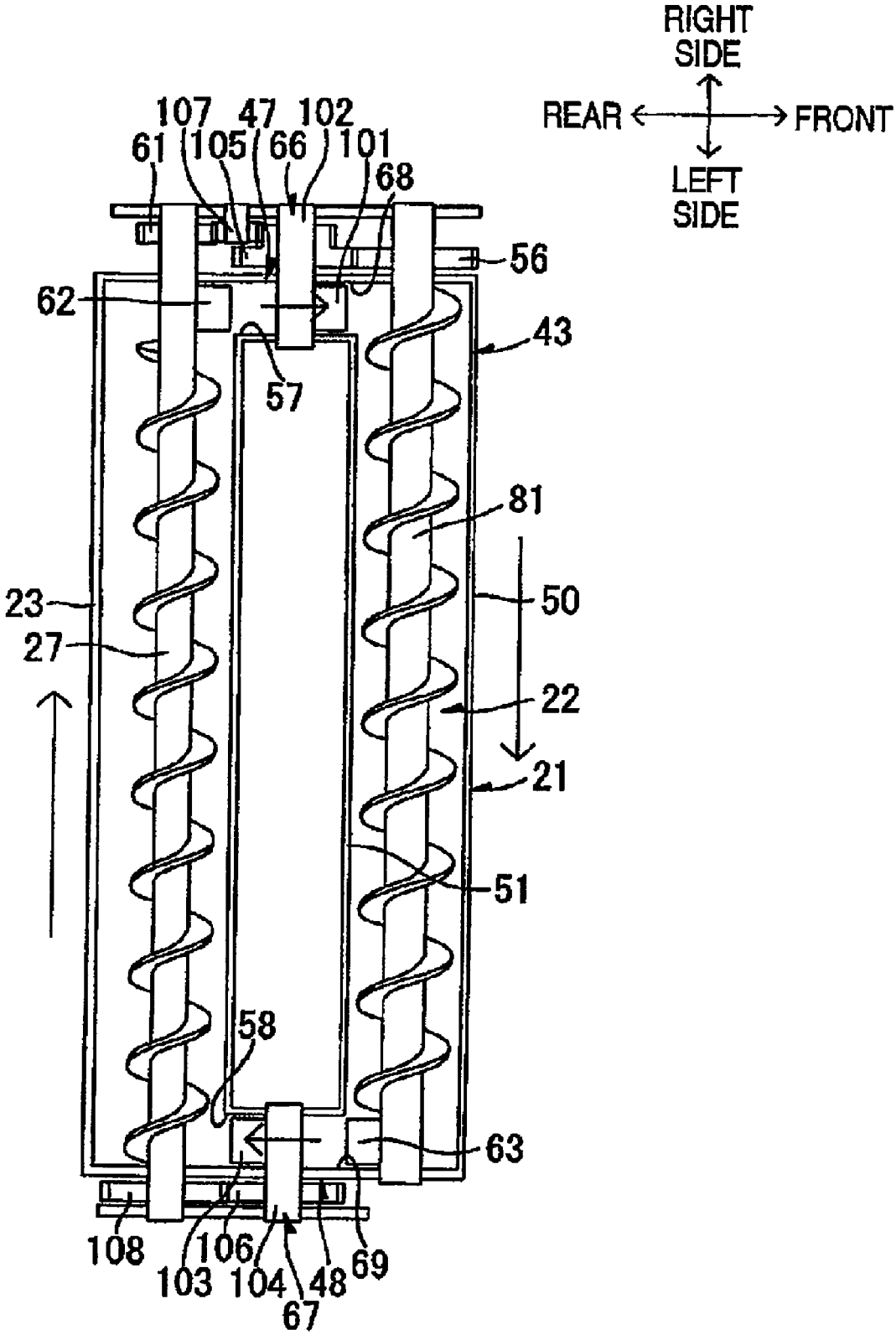
FIG. 23 is a plane cross section illustrating a variation of the second screw.

In the configuration shown in FIG. 23, at the left end of the second screw 81 on the outside of the left end of the toner supply chamber 23, the second screw drive gear 56 is provide so as not to be rotatable relatively. Furthermore, inside the right end part of the toner supply chamber 23, the toner supply blade 62 is provided at the right end of the second screw 25 to face the supply chamber side opening 57. The toner supply blade 62 is formed to be a plate-like member extending on one side of the radial direction of the second screw 81. It is understood that, according to the configuration shown in FIG. 23, the same advantages as those achieved by the above described third embodiment can be achieved.

What is claimed is:

1. A development device for supplying a developer to an image holding body, comprising:

a casing;

a developer reservoir formed at a bottom part of the casing to store the developer;

a developer supply chamber different from the casing and configured to accommodate the developer;

a developer holding body that is a roller-like member rotatable about a rotation axis extending in a width direction of the casing and that is located on an upper side of the developer reservoir in the casing such that an outer circumferential surface of the developer holding body is positioned to face the image holding body;

a first carry member provided in the developer supply chamber, extended in the width direction of the casing and configured to carry the developer in the width direction in which the rotation axis of the developer holding body extends, the first carry member being configured to supply the developer to the developer reservoir;

a second carry member provided on a casing side, extended in the width direction of the casing and configured to carry the developer in the width direction in which the rotation axis of the developer holding body extends; and a carry substrate provided in the casing, the carry substrate including a plurality of carrying electrodes configured to generate an electric field by application of a voltage such that the developer is carried from the developer reservoir to a position facing the developer holding body.

2. The development device according to claim 1, further comprising:

a supply opening formed in the casing to allow the developer to pass therethrough from the developer supply chamber to the developer reservoir; and a recovery opening formed in the casing to allow the developer to pass therethrough from the developer reservoir to the developer supply chamber, wherein:

the first carry member is configured to supply the developer to the developer reservoir through the supply opening while carrying the developer from the recovery opening toward the supply opening;

the second carry member is provided in the developer reservoir, and is configured to carry, from the supply opening toward the recovery opening, the developer supplied from the developer supply chamber; and the carry substrate is provided on an opposite side of the developer supply chamber on an inner wall of the casing such that the developer being carried from the supply opening to the recovery opening is carried to the position facing the developer holding body.

3. The development device according to claim 2, wherein the first carry member and the second carry member are provided to be parallel with each other along a horizontal direction.

4. The development device according to claim 2, wherein the carry substrate comprises a vertical carry part formed to carry the developer in a vertical direction.

5. The development device according to claim 2, wherein:

the inner wall of the casing on which the carry substrate is provided is formed to be straight when viewed as a side view so as to face the second carry member in a horizontal direction; and the developer is stored in the developer reservoir in a vertical direction such that a top of the developer is situated at a position which is lower than an upper edge of the second carry member and at which the top of the developer faces the inner wall of the casing on which the carry substrate is provided.

6. The development device according to claim 2, wherein:

the second carry member comprises a spiral part having a form of a spiral extending in the width direction of the casing; and the second carry member has a circular shape when viewed as a side view.

7. The development device according to claim 2, wherein the supply opening and the recovery opening are arranged to be parallel with each other in a horizontal direction.

8. The development device according to claim 1, further comprising:

a developer carry chamber that is provided in the casing to be located between the developer reservoir and the developer supply chamber; and a supply opening that is formed in the casing to allow the developer pass therethrough from the developer supply chamber to the developer carry chamber;

a recovery opening that is formed in the casing to allow the developer pass therethrough from the developer carry chamber to the developer supply chamber;

an opening that is formed in the casing to allow the developer pass therethrough from the developer carry chamber to the developer reservoir, wherein:

the second carry member is provided in the developer carry chamber to supply the developer to the developer reservoir through the opening while carrying, from the supply opening toward the recovery opening, the developer which has been supplied from the developer supply chamber;

the first carry member supplies the developer to the developer reservoir through the supply opening while carrying the developer from the recovery opening toward the supply opening; and the carry substrate is provided on an opposite side of the developer supply chamber on an inner wall of the casing such that the developer which has been carried to the developer reservoir through the opening is carried to the position facing the developer holding body.

9. The development device according to claim 8, wherein the opening is formed to extend throughout the width direction in the developer carry chamber and to face the second carry member.

10. The development device according to claim 8, further comprising an unstiffening member located in the developer reservoir to unstiffen the developer supplied to the developer reservoir through the opening.

11. The development device according to claim 8, wherein the carry substrate comprises a vertical carry part formed to carry the developer in a vertical direction.

12. The development device according to claim 1, further comprising:

a first developer carry chamber that is formed on one side in the width direction of the casing in the developer reservoir to allow the developer reservoir and the developer supply chamber to communicate with each other;

a second developer carry chamber that is formed on the other side in the width direction of the casing in the developer reservoir to allow the developer reservoir and the developer supply chamber to communicate with each other;

a third carry member that is provided in the first developer carry chamber to carry, toward the developer reservoir, the developer which has been carried by the first carry member; and a fourth carry member that is provided in the second developer carry chamber to carry, toward the developer supply chamber, the developer which has been carried by the second carry member, wherein:

the second carry member is provided in the developer reservoir; and the carry substrate is provided on a same side as the developer supply chamber on an inner wall of the casing such that the developer being carried from the first developer carry chamber to the second developer carry chamber is carried to the position facing the developer holding body.

13. The development device according to claim 12, wherein:

the first carry member and the second carry member are provided to be parallel with each other along a horizontal direction; and the third carry member and the fourth carry member are arranged along the horizontal direction along which the first carry member and the second carry member are arranged.

14. The development device according to claim 12, wherein the carry substrate comprises a vertical carry part formed to carry the developer in a vertical direction.

15. The development device according to claim 12, wherein:

the inner wall of the casing on which the carry substrate is provided is formed to be straight when viewed as a side view so as to face the second carry member in a horizontal direction; and the developer is stored in the developer reservoir in a vertical direction such that a top of the developer is situated at a position which is lower than an upper edge of the second carry member and at which the top of the developer faces the inner wall of the casing on which the carry substrate is provided.

16. The development device according to claim 12, wherein the second carry member comprises a spiral part having a form of a spiral extending in the width direction of the casing; and the second carry member has a circular shape when viewed as a side view.

17. The development device according to claim 12, further comprising:

a supply opening that is formed to allow the first developer carry chamber communicate with the developer reservoir; and a recovery opening that is formed to allow the second developer carry chamber communicate with the developer reservoir;

wherein the supply opening and the recovery opening are arranged to be parallel with each other in a horizontal direction.

18. An image forming device, comprising:

a image formation unit configured to form an image on a recording medium; and a development device according to claim 1 provided in the image forming unit.

19. The image forming device according to claim 18, wherein the image formation unit comprises:

the image holding body provided for each of predetermined colors;

the development device provided for each of the image holding bodies; and a transfer target member provided to face each image holding body, wherein a developer image is primarily transferred from each image holding body to the transfer target member, and then the developer image is secondarily transferred from the transfer target member to the recording medium.

* * * * *